US008875934B2

(12) United States Patent
Deka

(10) Patent No.: US 8,875,934 B2
(45) Date of Patent: Nov. 4, 2014

(54) HEAVY DUTY COOLER

(76) Inventor: Donald Deka, Jupiter, FL (US)

( * ) Notice: Subject to any disclaimer, the term of this patent is extended or adjusted under 35 U.S.C. 154(b) by 554 days.

(21) Appl. No.: 13/229,937

(22) Filed: Sep. 12, 2011

(65) Prior Publication Data

US 2013/0062356 A1 Mar. 14, 2013

(51) Int. Cl.
*A47J 39/00* (2006.01)
*F25D 3/14* (2006.01)
*B65D 81/38* (2006.01)

(52) U.S. Cl.
CPC ..... *F25D 3/14* (2013.01); *B65D 81/3823* (2013.01)
USPC ... 220/592.25; 220/529; 220/754; 220/23.88; 62/457.1; 62/441; 62/453; 62/459

(58) Field of Classification Search
CPC ..... F25D 3/14; B65D 81/3823
USPC ..... 220/529, 510, 530, 532, 533, 754, 220/592.25, 592.02, 592.05; 62/457.1, 62/457.2, 457.7, 440, 441, 452, 453, 459, 62/465
See application file for complete search history.

(56) References Cited

U.S. PATENT DOCUMENTS

| | | | | |
|---|---|---|---|---|
| 3,581,906 | A * | 6/1971 | Joyce | 211/126.5 |
| 4,551,988 | A | 11/1985 | Petrantoni | |
| D355,099 | S * | 2/1995 | Dell | D7/605 |
| 6,193,097 | B1 * | 2/2001 | Martin Perianes | 220/592.03 |
| 6,244,458 | B1 * | 6/2001 | Frysinger et al. | 220/592.09 |
| 6,446,988 | B1 | 9/2002 | Kho | |
| 6,763,678 | B2 * | 7/2004 | Harper | 62/461 |
| 7,013,670 | B2 | 3/2006 | Gonzalez et al. | |
| 7,048,135 | B2 * | 5/2006 | Smyers et al. | 220/6 |
| 7,950,249 | B1 * | 5/2011 | White et al. | 62/464 |
| 8,028,394 | B2 * | 10/2011 | Takaoka | 29/527.1 |

* cited by examiner

*Primary Examiner* — Robert J Hicks
*Assistant Examiner* — Kareen Rush
(74) *Attorney, Agent, or Firm* — McHale & Slavin, P.A.

(57) ABSTRACT

An ice chest or portable cooler is disclosed which includes a unique construction which enables the cooler to maintain the contents therein at or below a desired temperature for an extended period of time. The top, walls, and bottom of the cooler utilize a shell which includes an inner and outer layer of a plastic and a relatively thick layer of an insulation material between the layers of plastic. The construction adds strength and rigidity to the cooler, while not increasing the weight as a result of the relatively light insulation material.

9 Claims, 33 Drawing Sheets

HEAVY DUTY COOLER

FIELD OF THE INVENTION

The present invention relates to a container for maintaining the contents of the container at a desired temperature for an extended period of time. In particular, the present invention relates to a portable container, such as an ice chest, that can maintain the contents of the container at a desired temperature for an extended period of time without the use of cyclic refrigeration.

BACKGROUND OF THE INVENTION

Containers for chilling the contents therein to a desired temperature and then maintaining the contents at that temperature have been known for some time. However, these containers are normally relatively large and rely on cyclic refrigeration to maintain the contents of the container at the desired temperature. The cyclic refrigeration requires the use of electricity for its operation. There exists a need to maintain certain items, such as foodstuffs, at a desired temperature in areas where electricity is not readily available. For example, when traveling in an automobile, when traveling in a relatively small watercraft and when in a remote location, such as on a picnic.

A common remedy to the problem of maintaining items, such as foodstuffs, at a desired temperature is to place the items and ice in a portable insulated container. Ice chests are commonly used for this task. However, ice does not stay frozen for extended periods of time and, if the container is not well insulated, the ice will melt rapidly and the contents of the container will not be maintained at the desired temperature. Dry ice or frozen carbon dioxide has been utilized in place of ice or frozen water to maintain the contents of a container at a relatively low temperature for an extended period of time. However, there are drawbacks to the use of dry ice. It is relatively expensive. It can cause damage to the skin when not handled properly. It is not readily available.

Accordingly, there exists a need for a portable container constructed to substantially reduce thermal conductivity between the exterior and interior of the portable container. This new and improved construction would enable the container to keep and maintain the contents thereof at a desired temperature for an extended period of time. Also, the means to maintain the temperature within the container should be relatively inexpensive and readily available.

DESCRIPTION OF THE PRIOR ART

U.S. Pat. No. 7,013,670 discloses a portable ice chest for keeping the contents thereof in a cooled or frozen state for a period of time. The ice chest includes an insulated cover with an inner compartment. There is also an insulated container with a bottom compartment. The cover is constructed for an air-tight fit upon the top opening of the insulated container. In order to maintain the contents of the ice chest in a frozen state, dry ice is placed in the inner compartment only. In order to maintain the contents of the container in a refrigerated state, dry ice is placed in the bottom compartment only. When no dry ice is used, the ice chest can be employed as a conventional ice chest.

U.S. Pat. No. 6,446,988 discloses a cooler or ice chest which has been provided with wheels so as to be readily pulled or towed. A novel handle design is employed which resists torsion. Provision is made for the handle to be folded down and stored on the cooler when it is not being used for pulling the cooler. The cooler is V-shaped, thus providing good ground clearance for the back end of the cooler when being pulled over uneven ground.

U.S. Pat. No. 6,193,097 discloses a portable cooler which includes a container body made from an insulating material and a top cover for the body which includes two areas, top and bottom. The bottom area having a lesser profile defining a resting edge for an intermediate drilled plate. The top area includes a plurality of removable compartments for keeping food and drinks and the ice, resting on the intermediate plate. The cooler has a liquid tank at its lower end which receives liquid defrosting from the ice through the drilled intermediate plate. The liquid tank includes a drain for removing the liquid therein.

U.S. Pat. No. 4,551,988 discloses a chambered cooler for insertion into an ice chest including a chest base having upstanding side walls and a bottom wall forming an open ended chest enclosure. The chest enclosure includes a chest lid for enclosing the open end of the chest enclosure. The chest is dimensioned to retain articles therein.

Accordingly, what is needed in the art is a cooler or ice chest which can maintain the contents thereof in a chilled or cooled state for an extended period of time. The cooler should also be portable and use conventional ice made from water for the coolant.

SUMMARY OF THE INVENTION

An ice chest or portable cooler is disclosed which includes a unique construction which enables the cooler to maintain the contents therein at or below a desired temperature for an extended period of time. The top, walls, and bottom of the cooler utilize a shell which includes an inner and outer layer of a plastic and a relatively thick layer of an insulation material between the layers of plastic. The construction adds strength and rigidity to the cooler, while not increasing the weight as a result of the relatively light insulation material.

Accordingly, it is an objective of the present invention to provide a cooler having the components thereof, the top, bottom, and walls, formed of a unique construction which enables substantially reduced thermal conductivity between the inner and outer surfaces of the top, bottom, and walls.

It is a further objective of the present invention to provide a cooler which includes a unique construction that enables the cooler to maintain the contents therein at or below a given temperature for an extended period of time.

It is yet another objective of the present invention to provide a cooler with a hinge which enables the cooler to be opened flush against a wall.

It is a still further objective of the present invention to provide a hinge which provides better strength and insulation properties than conventional hinges on coolers.

It is still yet another objective of the present invention to provide a cooler which includes removable interior dividers which can also function as a cutting board.

It is still yet a further objective of the present invention to provide a cooler which is available in various sizes to accommodate various needs.

It is still yet another objective of the present invention to provide a cooler which includes a novel latch to maintain the cooler in a closed and airtight condition.

Other objects and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 1:
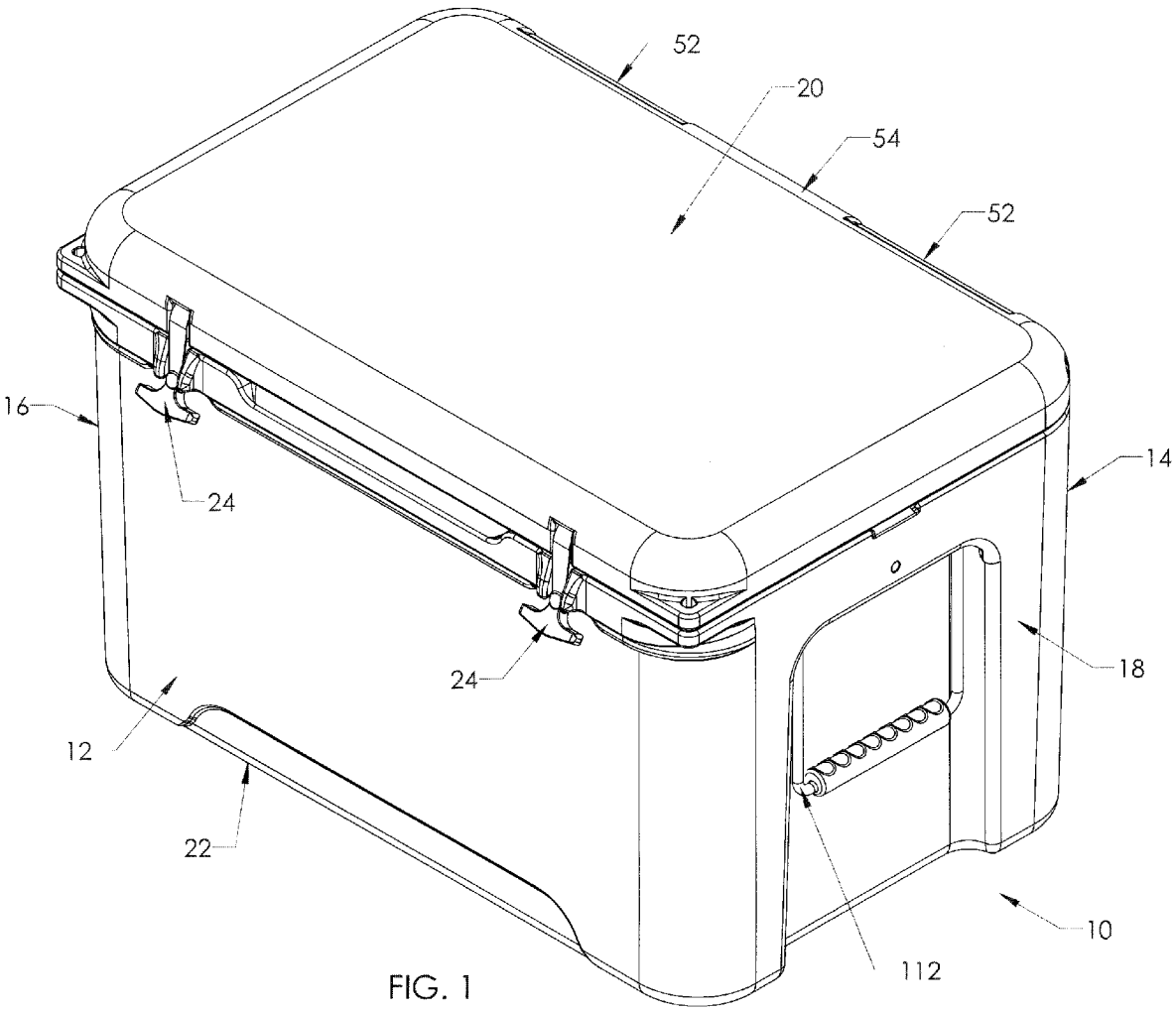
FIG. 1 is a front perspective view of a first embodiment of the present invention.

While the present invention is susceptible of embodiment in various forms, there is shown in the drawings and will hereinafter be described a presently preferred, albeit not limiting, embodiment with the understanding that the present disclosure is to be considered an exemplification of the present invention and is not intended to limit the invention to the specific embodiments illustrated.

FIGS. 1-35, which are now referenced, illustrate the present invention and the manner in which it is assembled. A first embodiment of the present invention is illustrated as a cooler or ice chest 10 in FIG. 1. This embodiment includes a cooler which comprises a front wall 12, a back wall 14, a left end wall 16, a right end wall 18, a top 20, and a bottom 22. The left end wall, right end wall, front wall, back wall, and bottom are preferably integrally formed together as a single piece. The top is hingedly secured to the back wall. Latches 24 releasably secure the top to the remainder of the cooler.

Figure 2:
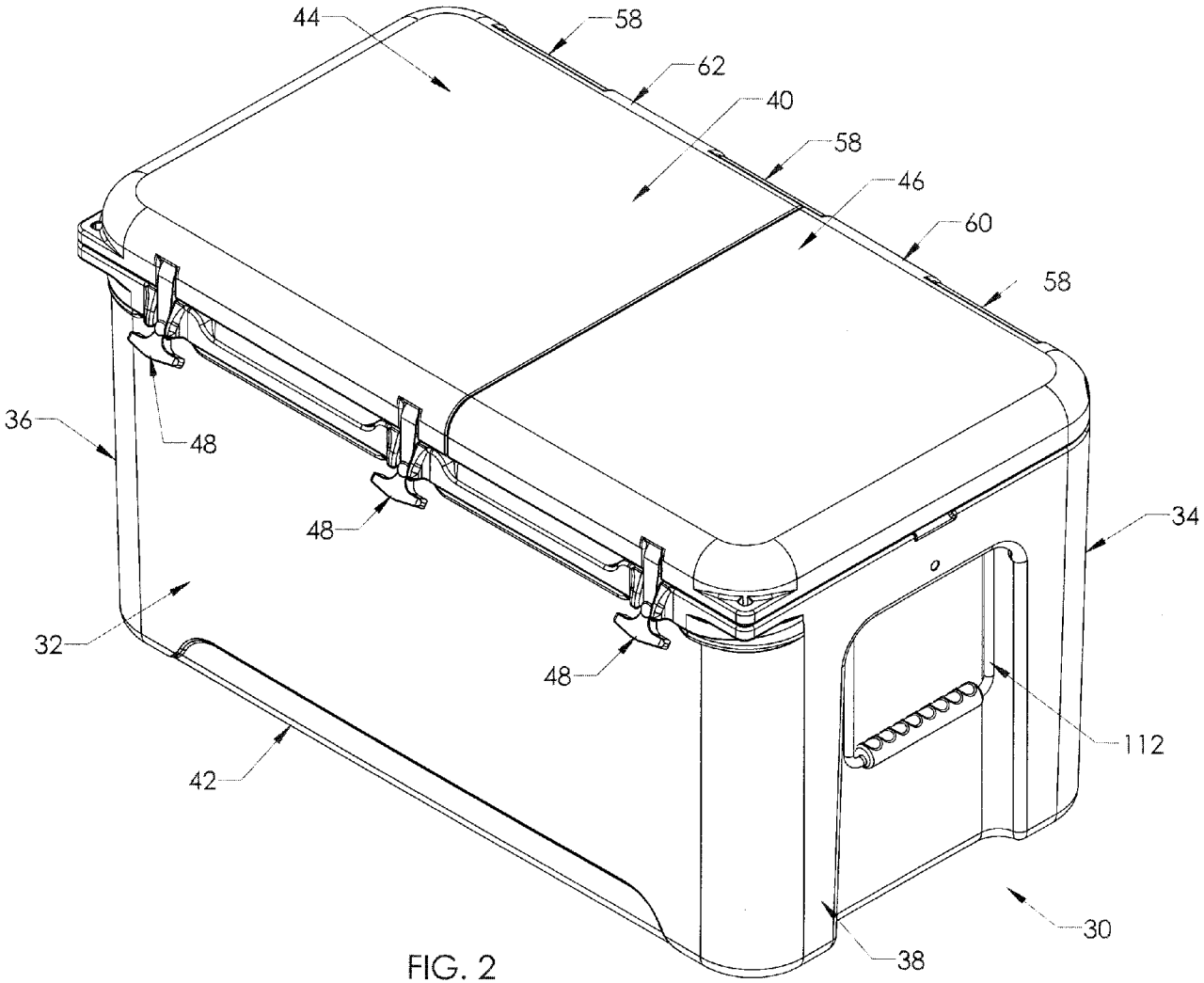
FIG. 2 is a front perspective view of another embodiment of the present invention.

A second embodiment of the invention is illustrated as cooler 30 in FIG. 2. The second embodiment includes a cooler which comprises a front wall 32, a back wall 34, a left end wall 36, a right end wall 38, a top 40, and a bottom 42. The left end wall, right end wall, front wall, back wall, and bottom are preferably integrally formed together as a single piece. The top comprises two pieces 44 and 46. Both tops 44 and 46 are hingedly secured to the back wall. Latches 48 releasably secure the top to the remainder of the cooler. Each top 44 and 46 can be individually opened and closed.

Figure 3:
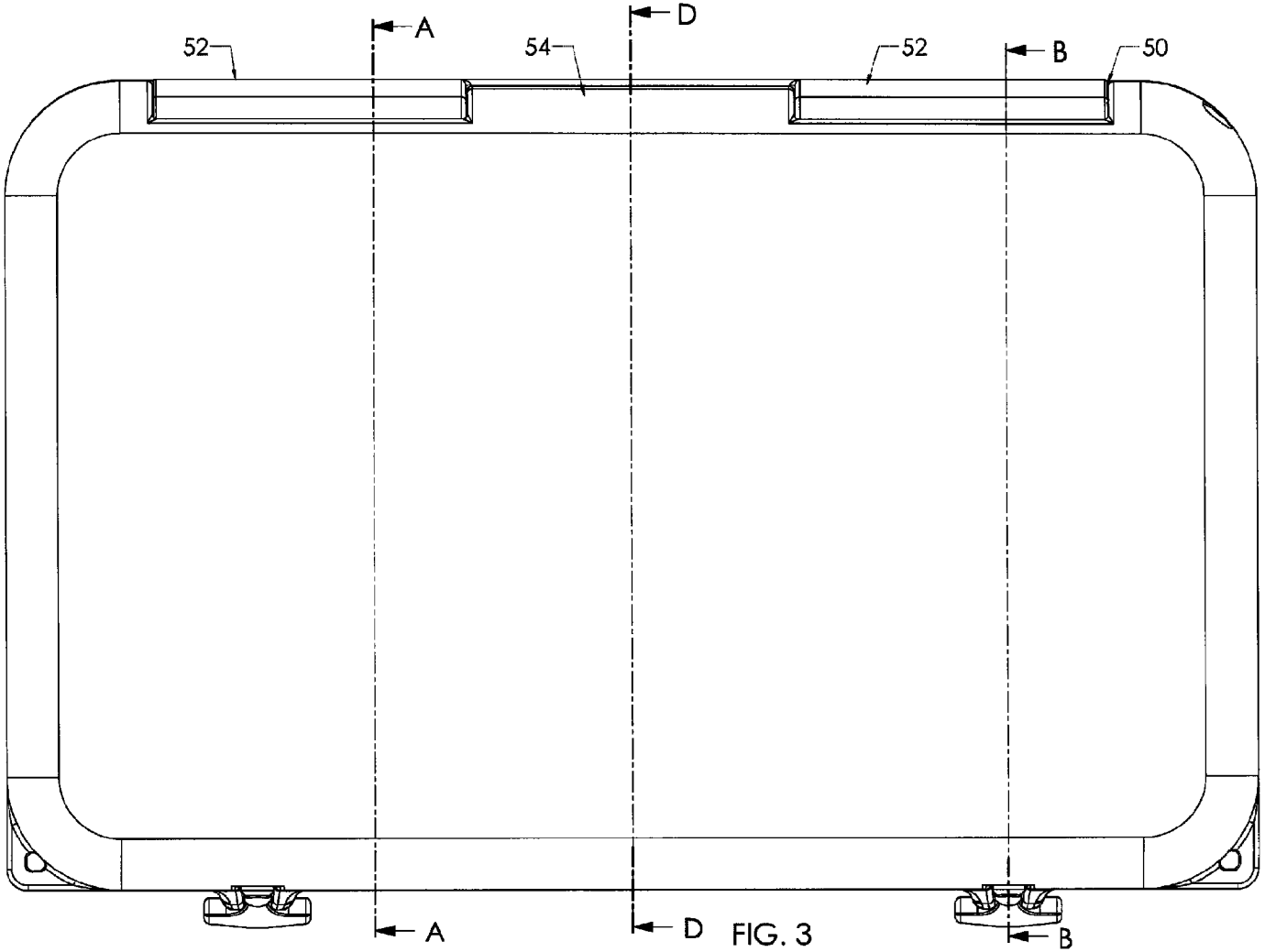
FIG. 3 is a top view of the embodiment illustrated in FIG. 1.
Figure 4:
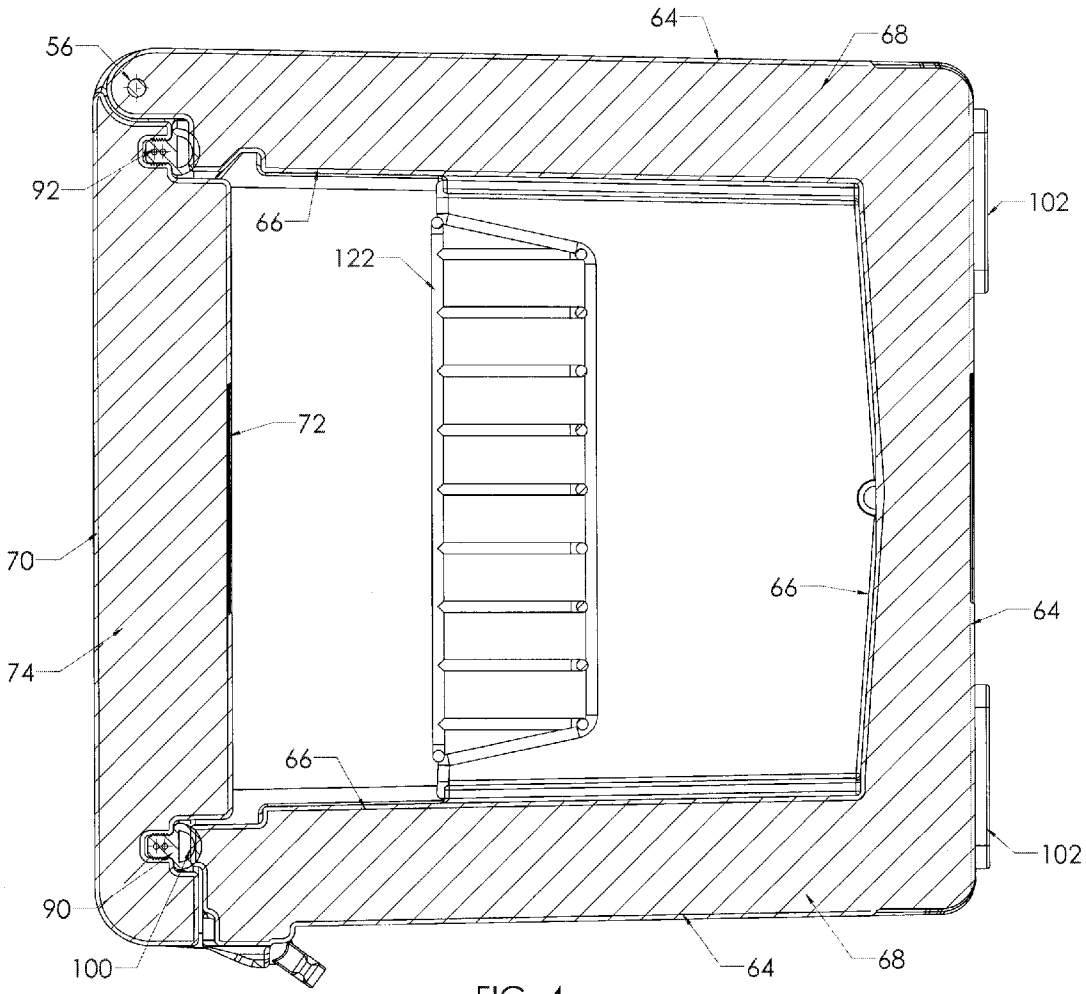
FIG. 4 is a cross-sectional view taken along line A-A in FIG. 3.
Figure 7A:
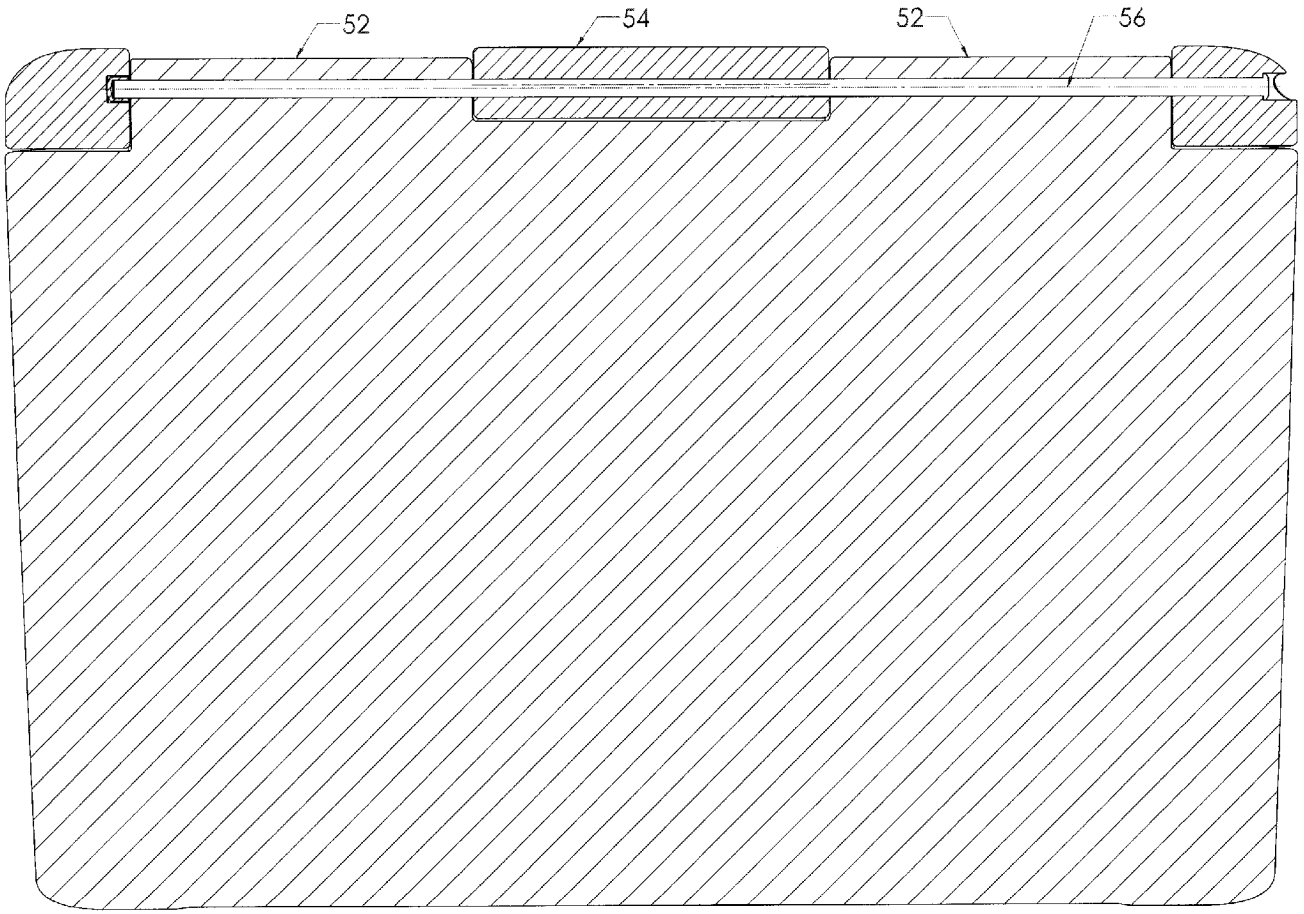
FIG. 7A is a cross-sectional view taken along line C-C in FIG. 6.
Figure 7B:
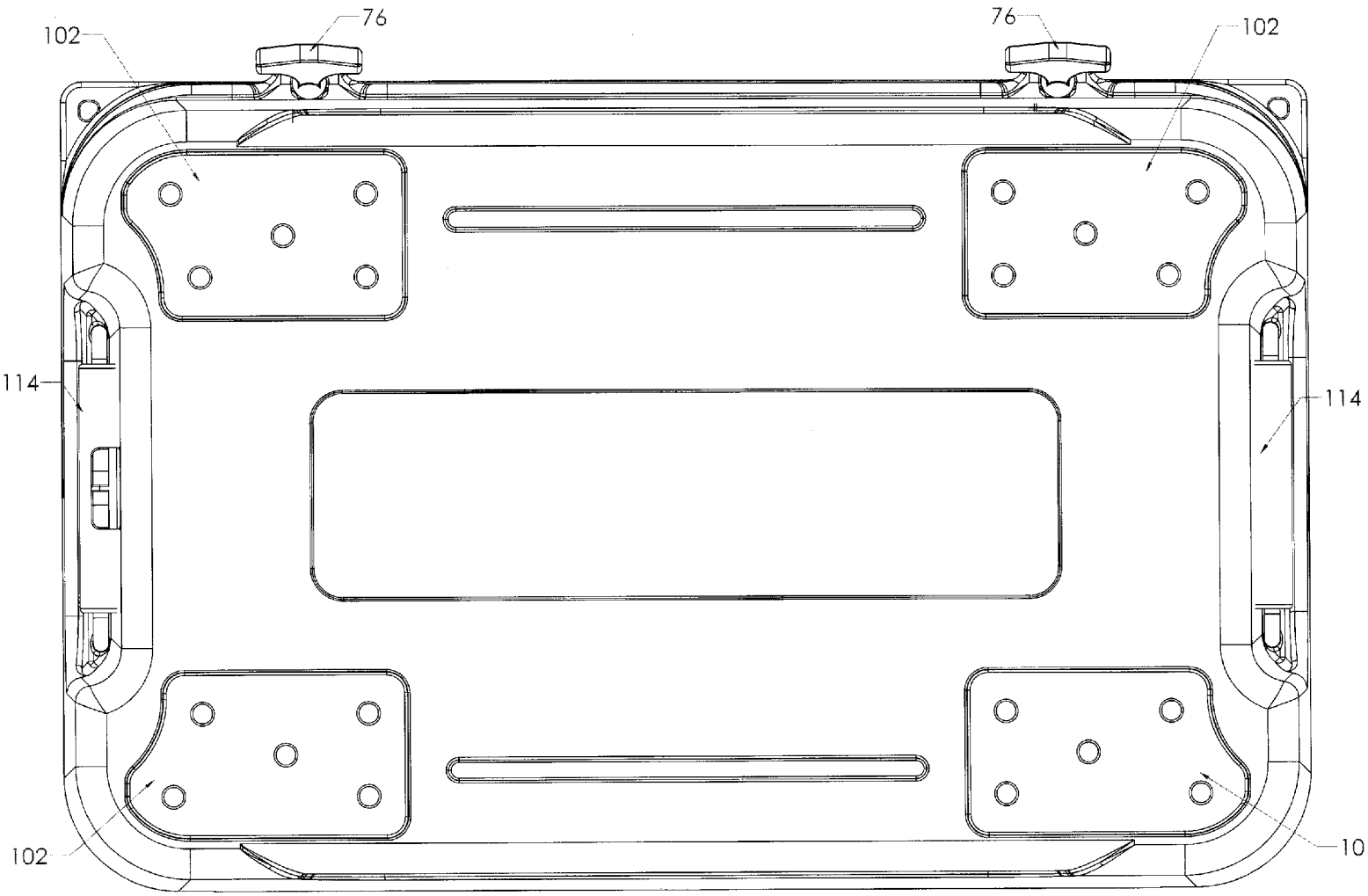
FIG. 7B is a bottom view of the cooler embodiments in FIGS. 1 and 2.

FIG. 3 illustrates the top 20 of the embodiment 10 in FIG. 1. A hinge 50 includes elements 52 molded to the back 14 of the cooler as illustrated in FIG. 7A, element 54 molded to the top 20 of the cooler as illustrated in FIG. 3, and pin 56 (FIGS. 4 and 7A). FIG. 2 illustrates the hinge construction of the second embodiment of the present invention. Hinge elements 58 are molded to the back 34 of the cooler. Hinge element 60 is molded to top 46 of the cooler and hinge element 62 is molded to the top 44 of the cooler. A single pin (not shown) permits the hinge members to pivot with respect to each other. This construction enables tops 44 and 46 to be opened and closed separately from each other. The ability to open separate tops helps to preserve and maintain the cool environment within the cooler. The hinge elements 52 and 54 in the first embodiment enable the top 20 to be raised and in vertical alignment with the back wall 14 of the cooler. The hinge elements 58, 60, and 62 in the second embodiment enable the tops 44 and 46 to be raised and in vertical alignment with the back wall 34 of the cooler.

The front wall 12, back wall 14, left end wall 16, right end wall 18, and bottom 22 of the first embodiment, illustrated in FIG. 1, are molded together as a single piece. These elements include an outer layer or thickness 64 of a high density plastic, such as polyethylene, and an inner layer or thickness 66 of a high density plastic, such as polyethylene, see FIGS. 4 and 5A. In a preferred embodiment the layers 64 and 66 are 6 mm thick. However, other thicknesses can also be employed. Positioned between layers 64 and 66 is a layer or thickness 68 of foam, such as polyurethane foam. This foam is relatively thick to provide substantial insulation for the cooler. In a preferred embodiment the foam is 3 inches thick. However, other thicknesses of foam insulation can also be employed. The high density plastic increases the rigidity and strength of the cooler and enables it to be manufactured in larger sizes. These larger sizes enable a greater amount of food and comestibles to be safely retained within the cooler. The larger size coolers also contain a greater amount of ice. The high density plastic enables the coolers to carry this additional ice without damage to the cooler.

Figure 5A:
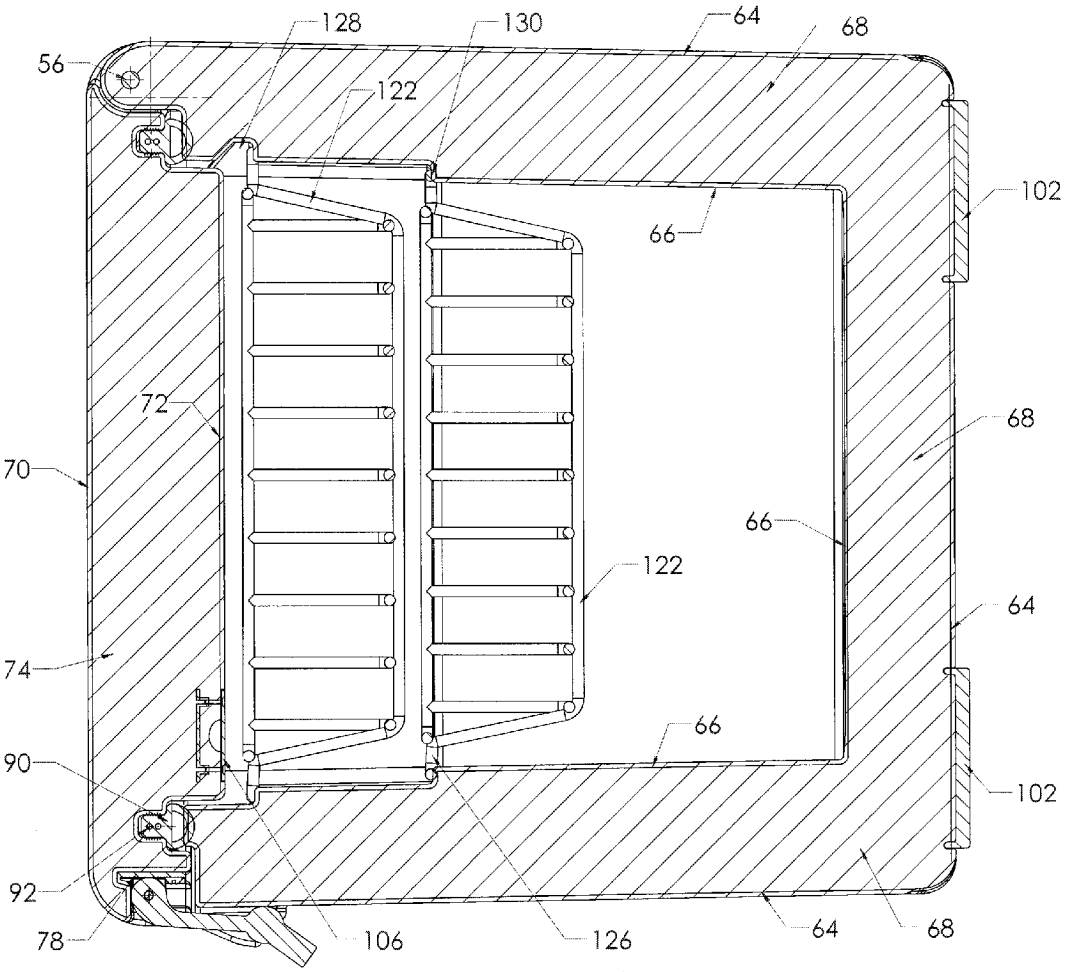
FIG. 5A is a cross-sectional view taken along line B-B in FIG. 3.
Figure 5B:
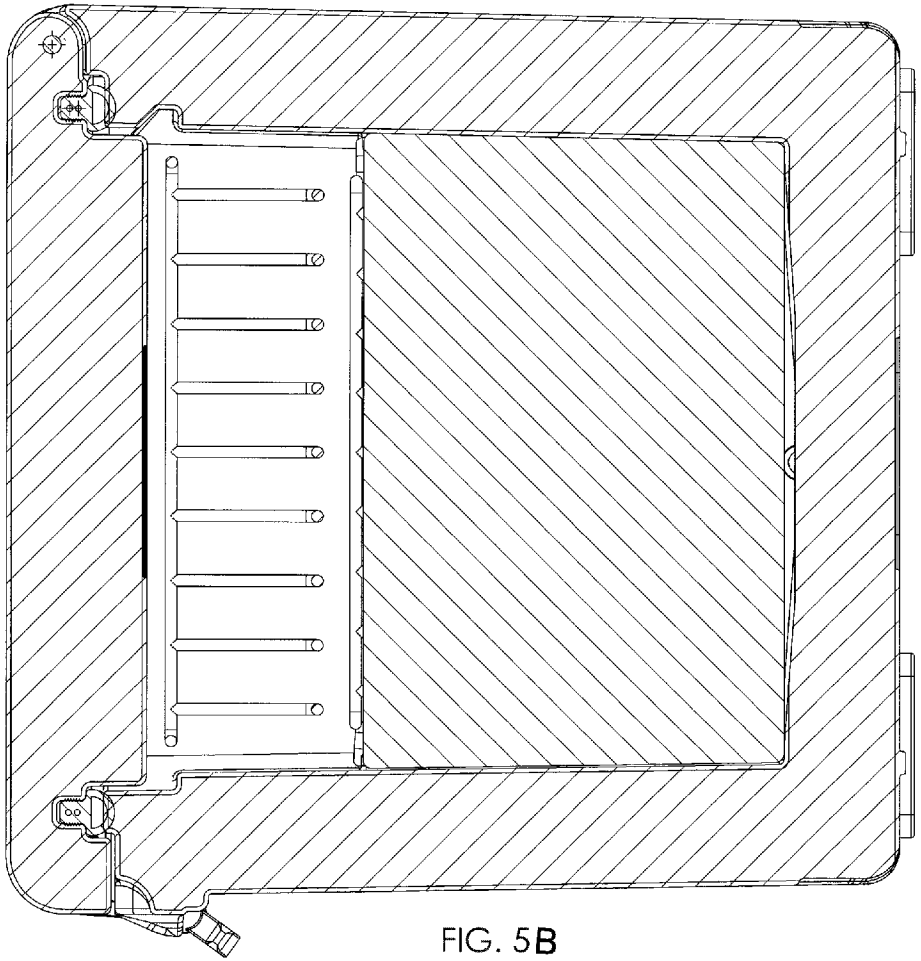
FIG. 5B is a cross-sectional view taken along line D-D in FIG. 3.
Figure 6:
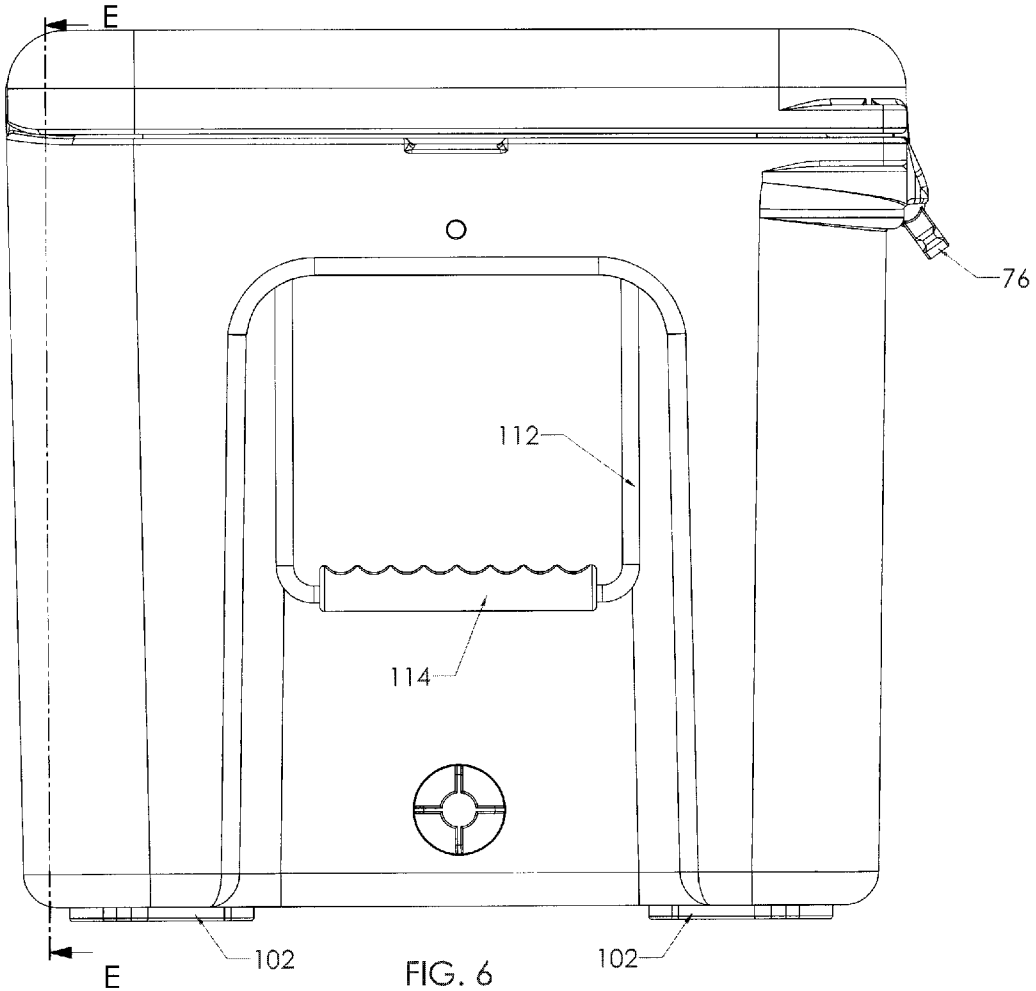
FIG. 6 is an end view of the cooler of the present invention.

The top 20 of the cooler has a construction similar to the front, back, end walls and bottom. As illustrated in FIGS. 4 and 5A, the top 20 includes an outer layer or thickness 70 of a high density plastic, such as polyethylene, and an inner layer or thickness 72 of a high density plastic, such as polyethylene. In a preferred embodiment the layers 70 and 72 are 6 mm thick. However, other thicknesses can also be employed. Positioned between layers 70 and 72 is a layer or thickness 74 of foam, such as polyurethane foam. This foam is relatively thick to provide substantial insulation for the cooler. In a preferred embodiment the foam is 3 inches thick. However, other thicknesses of foam insulation can also be employed. The high density plastic increases the structural rigidity of the top of the cooler and enables it to withstand increased loads placed thereon. The foam 74 is relatively thick to provide substantial insulation for the cooler. The hinges 52, 54, 58, 60, and 62 are formed completely from a high density plastic. There is no foam used in the formation of the hinges. This construction of the hinges increases the thermal nonconductivity of the cooler, thus enabling the cooler to keep and maintain the contents therein at or below a desired temperature.

Figure 14:
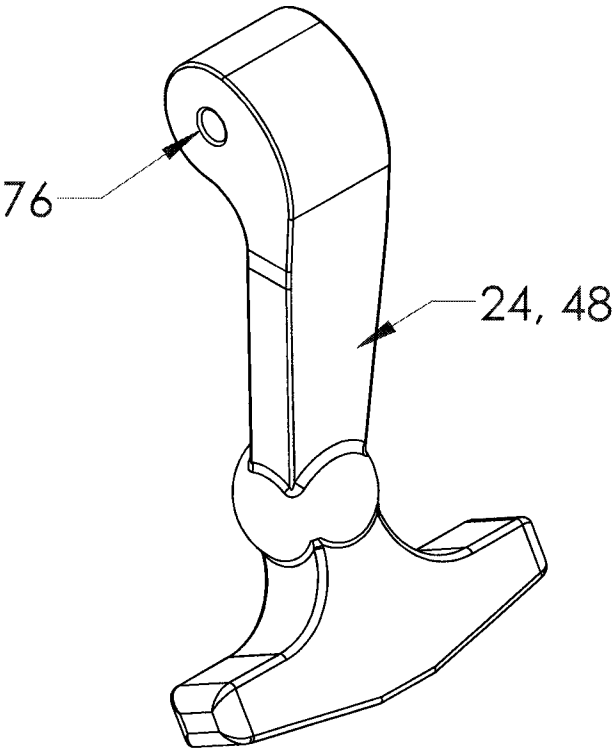
FIG. 14 is a perspective view of a closure latch of the present invention.
Figure 15:
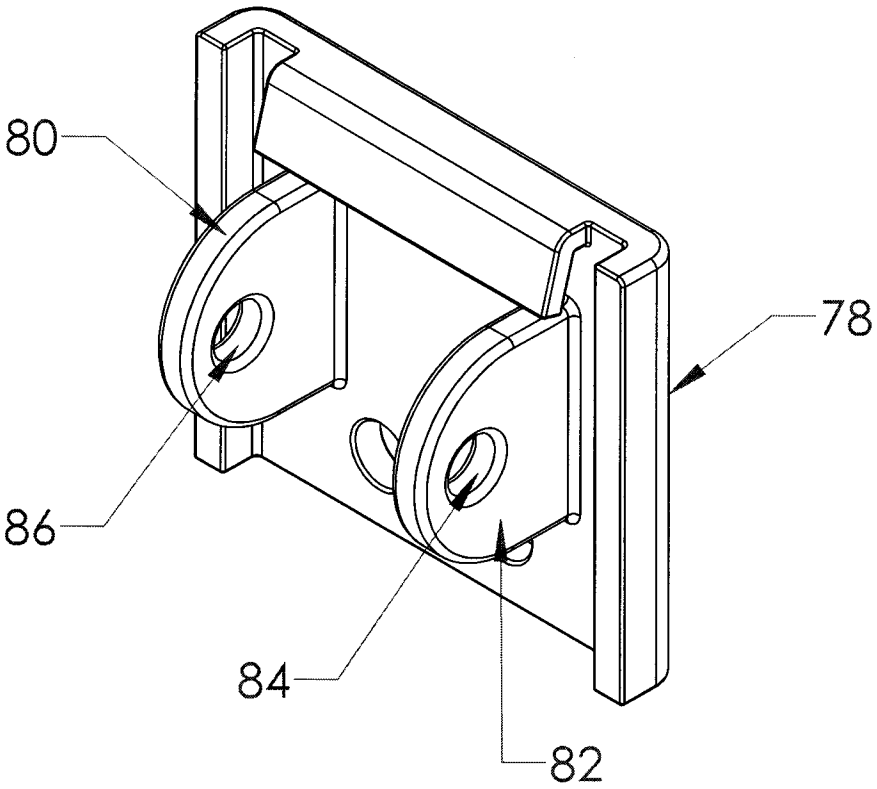
FIG. 15 is a perspective view of the mounting device for the closure latch.

Latches 24 and 48 are employed to keep the cooler top closed. These latches also help to maintain the top in a sealed condition with respect to the front, back and end walls of the cooler. Latches 24 and 48 are constructed the same, as illustrated in FIG. 14. The top portion of each latch includes an aperture 76 into which a pin can be inserted. A spherical or ball shaped element 77 is located adjacent an end of the latch which includes a handle 79. A latch attaching member 78 is secured to a front portion of the tops 20, 44, and 46. The latch attaching member 78 includes extensions or ears 80 and 82 which extend outwardly from the latch member (FIG. 15). Each of the extensions, 80, 82 include an aperture 84, 86 respectively. The top of each of the latches 24, 48 is positioned between the extensions 80 and 82. A pin is inserted in apertures 76, 80, and 82. This construction enables the latches 24, 48 to pivot between a down, closed position and an up, open position.

Figure 8:
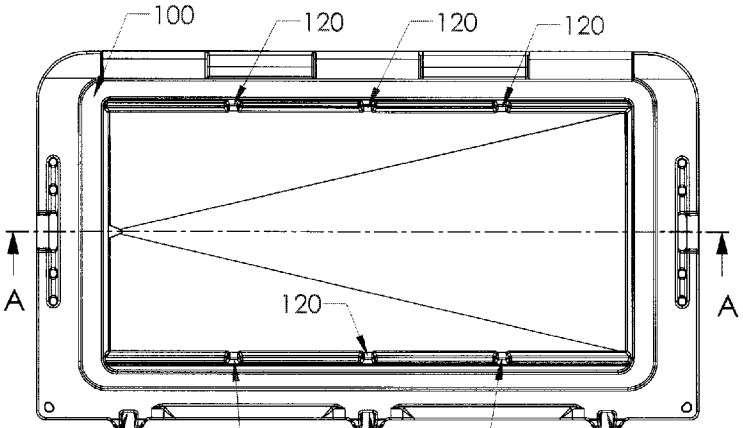
FIG. 8 is a top view of the embodiment illustrated in FIG. 2 with the top removed.
Figure 10:
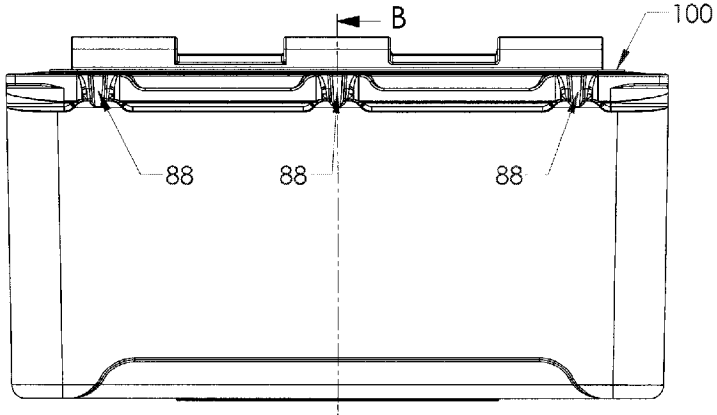
FIG. 10 is a front view of the embodiment illustrated in FIG. 8.

When the latches 24, 48 are in their closed positions they engage slots 88 (FIGS. 8 and 10). Slots 88 are located along the top edge of the front walls 12, 32 of the cooler. Slots 88 include indents, not shown, which receive the ball portion 78 of the latches 24, 48. The positioning of the ball in the indent helps to maintain the latches in a closed position. FIG. 5A illustrates the interlocking engagement of the latch 24, 48 and slot 88. This engagement enables the tops 20, 44 and 46 to maintain a relatively tight seal against the top edges of the front, back and end walls of the coolers. This tight seal enables the cooler to maintain the contents therein at or below a desired temperature for an extended period of time, far beyond that of other coolers.

Figure 12:
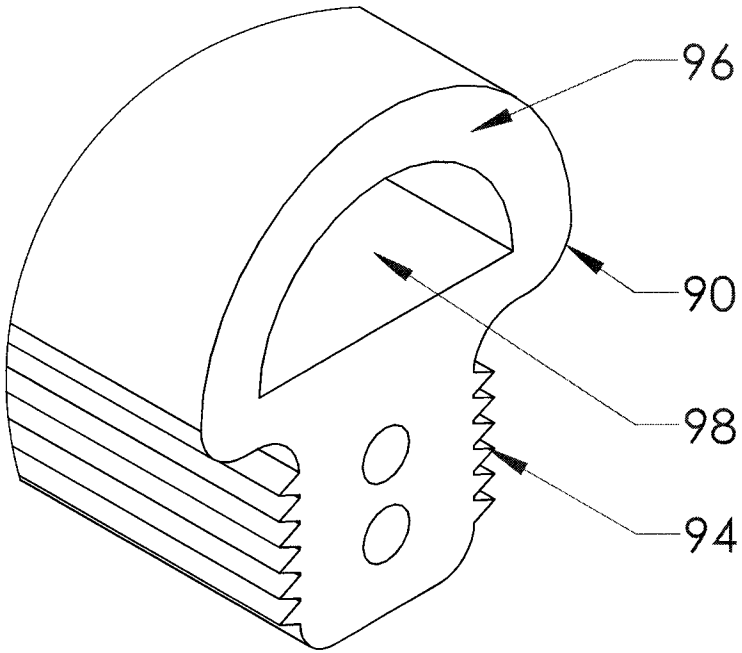
FIG. 12 is a cross-sectional view of the seal and securing means to retain the seal in the top of the cooler.
Figure 13:
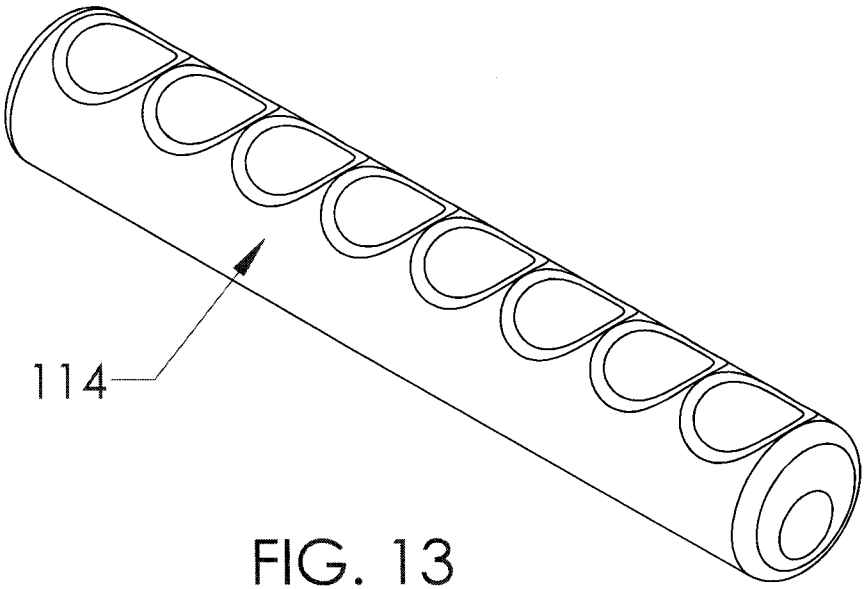
FIG. 13 is a perspective view of a handle for the present invention.

A seal 90 (FIG. 12) is located underneath the tops 20, 44 and 46 of the coolers. The seal 90 extends completely around the periphery of the tops. As illustrated in FIGS. 4 and 5A, the seal 90 is located inwardly from the outer circumferential edge of the tops. The seal 90 is set into a groove 92 which extends around the periphery of the tops of the cooler. The seal is maintained in the groove by a friction fit between the seal 90 and the groove 92. A portion 94 of the seal 90 is inserted into the groove 92 to hold the seal in the groove (FIG. 12). Other means, such as fasteners, adhesive, etc., can also be utilized to maintain the seal 90 in groove 92. Seal 90 includes a flexible portion 96 which deforms and maintains a sealed condition when the top is closed and the latches are engaged. The interior 98 of the seal may contain air or other gases. These gases can help to maintain the contents of the cooler at or below a desired temperature.

The seal 90 abuts against a ridge 100 (FIGS. 4, 8, and 11) which extends around an upper edge of the front, back and end walls of the cooler. The ridge helps to assure an air tight, thermal barrier between the exterior of the cooler and the interior of the cooler. The flexibility of the seal 90 permits the seal to compensate for any imperfections in the ridge 100, should any imperfections occur. The seal 90 is preferably formed as a single piece. However, the seal 90 can also be formed as multiple pieces which are abutted together in the groove 92. While the material used for the seal 90 is preferably an elastomeric material, any other similar, flexible material, such as rubber, plastics, felt, etc., can also be used to make the seal 90.

Figure 19:
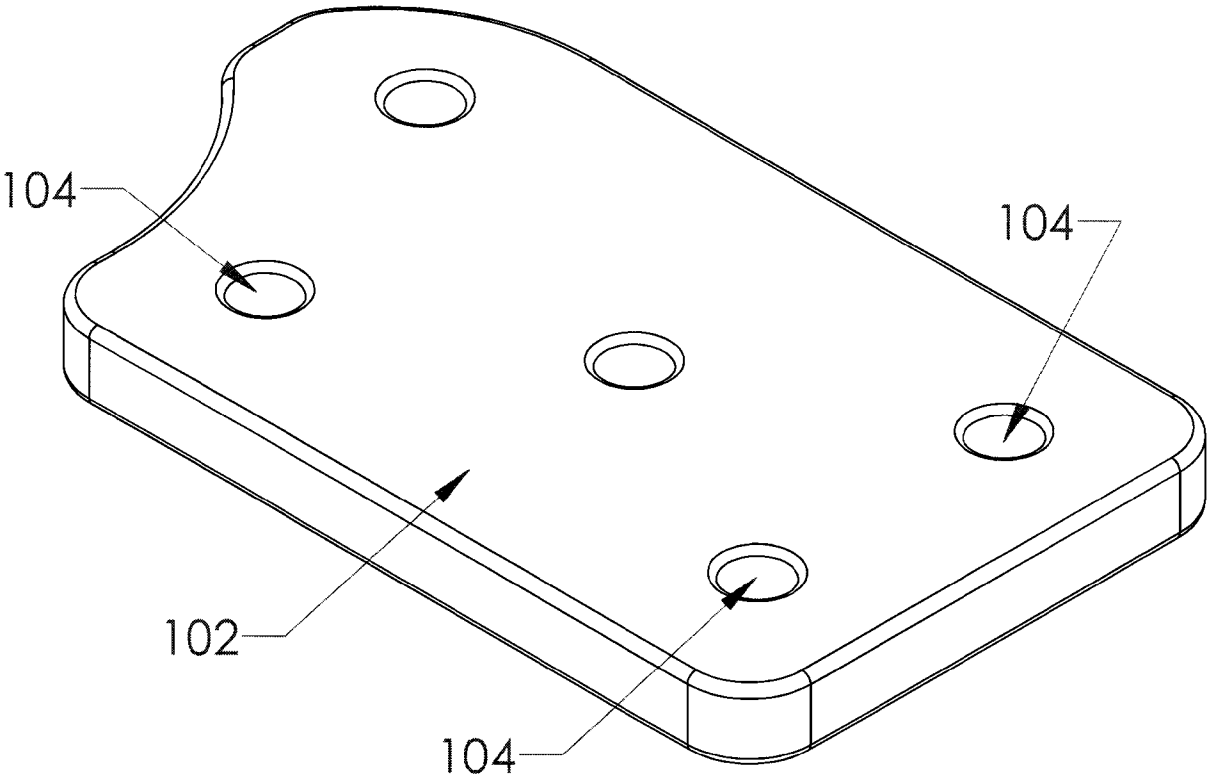
FIG. 19 is a perspective view of one of the supporting elements or feet of the present invention.
Figure 23:
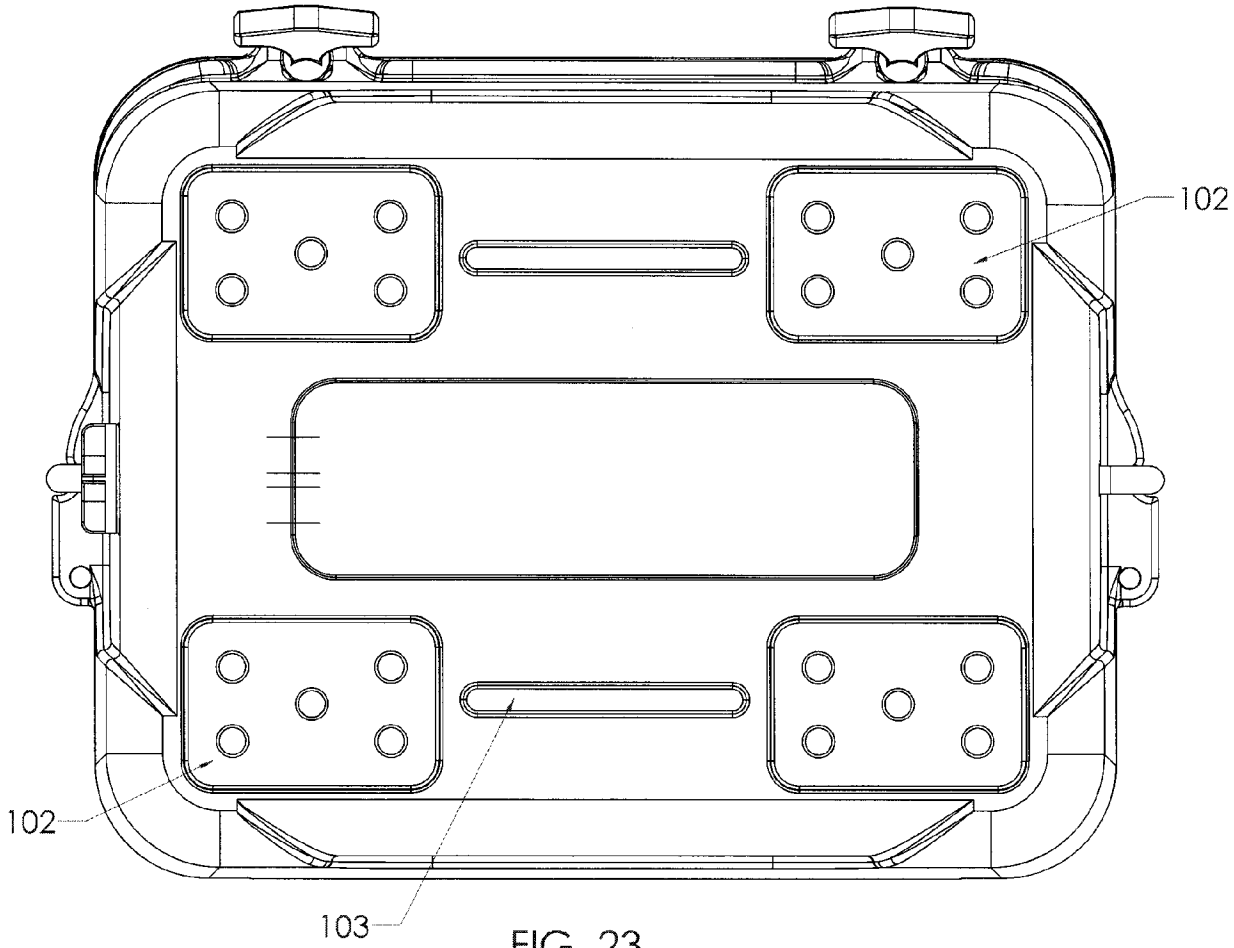
FIG. 23 is a bottom view of another embodiment of the present invention.

The bottoms 22 and 42 of the coolers 10 and 30 have a plurality of feet or supports 102 located thereon (FIGS. 4-6 and 23). A detailed view of the foot or support 102 is illustrated in FIG. 19. Each foot or support 102 includes a plurality of apertures 104. The feet or supports 102 space the bottom of the cooler away from the surface that the cooler is placed on. A plurality of skid rails or bars 103 are also located on the bottom of the cooler, as illustrated in FIG. 23. These feet and rails help to protect the bottom of the cooler from abrasion and other deleterious affects of interaction between the cooler and support surfaces. While a preferred embodiment of the invention utilizes four feet or supports 102, any number of supports can be utilized on a cooler.

Figure 16:
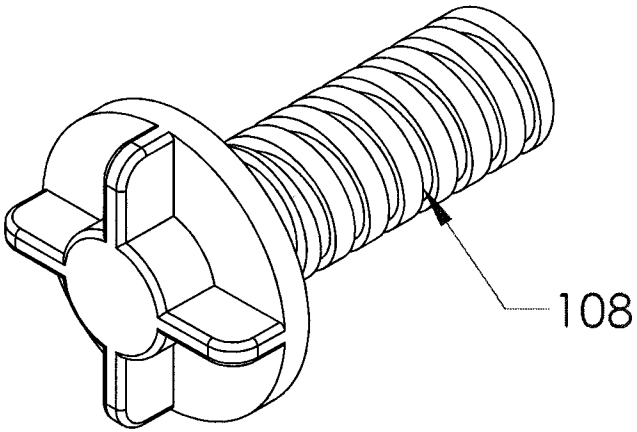
FIG. 16 is a perspective view of a drain plug of the present invention.
Figure 18:
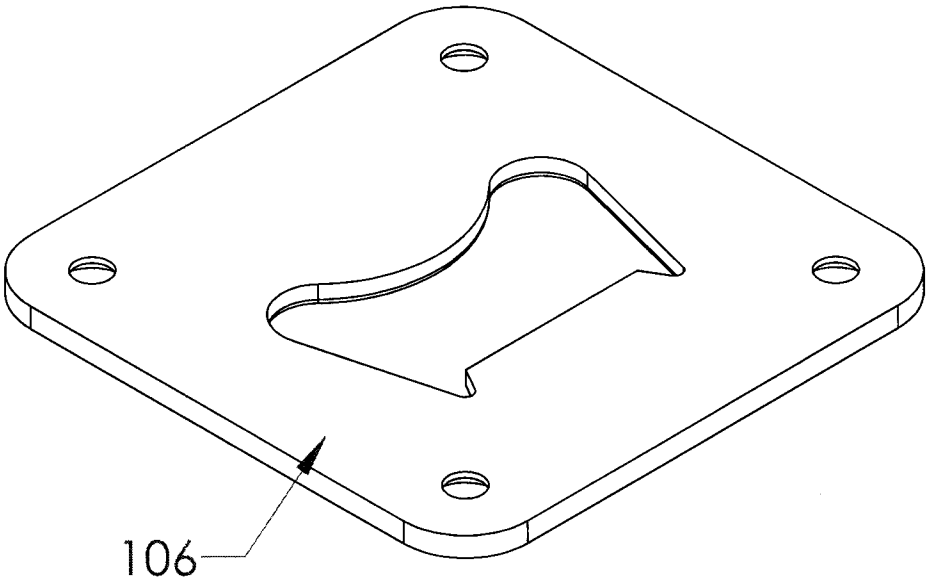
FIG. 18 is a perspective view of a bottle cap opener of the present invention.

FIG. 18 illustrates an opener 106 for a bottle cap. The opener 106 is preferably located on an underside of the top of the cooler, as illustrated in FIG. 5A. However, the opener 106 can be located anywhere on the cooler. A plug or stopper 108 is illustrated in FIG. 16. The plug or stopper 108 is inserted into an aperture or opening 110 (FIG. 9) located adjacent the bottom and at one end of the interior of the cooler. The aperture 110 is utilized to drain fluids, such as water, from the interior of the cooler. While the preferred embodiment of the plug 108 is illustrated as threaded, it can also have other shapes and be held in the aperture 110 by a friction fit. Further, the plug can employ a mechanism which expands the exterior of the plug after it has been inserted into the aperture 110.

The end walls 16, 18, 36 and 38 of the coolers are provided with handles to assist in lifting and carrying the coolers. Each handle 112 (FIG. 13) is preferably rope. Other materials could also be utilized to form handle 112. The handle 112 also preferably includes a grip 114 at one end thereof. The grip 114 can be provided with depressions or grooves into which an individual can place their fingers to obtain a better and more comfortable grip on the handle 112. The handles 112 are normally resting flat against the end walls of the coolers, as illustrated in FIGS. 1 and 2. However, when it is desired to lift and carry the coolers, the handles will pivot about end portions 116 so as to extend outwardly from the end walls of the coolers and enable an individual to transport the cooler.

Figure 9:
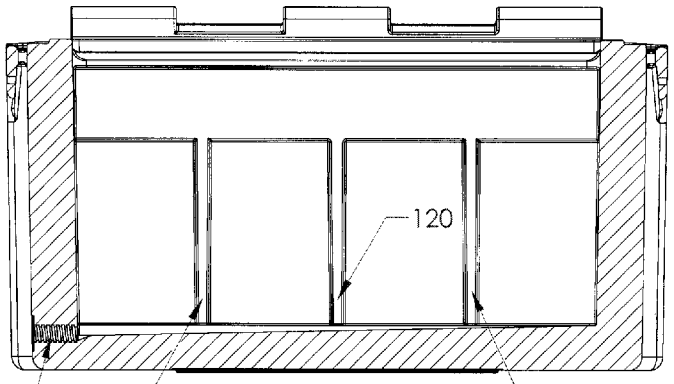
FIG. 9 is a cross-sectional view taken along line H-H in FIG. 8.
Figure 11:
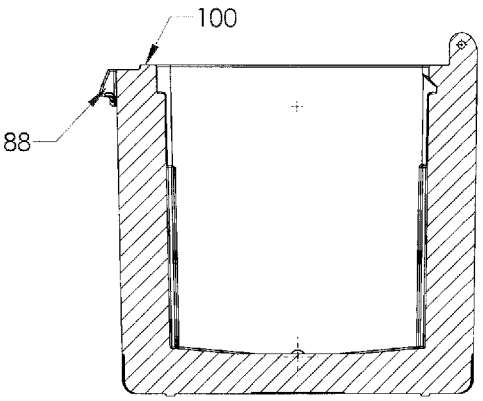
FIG. 11 is a cross-sectional view taken along line B-B in FIG. 10.
Figure 17:
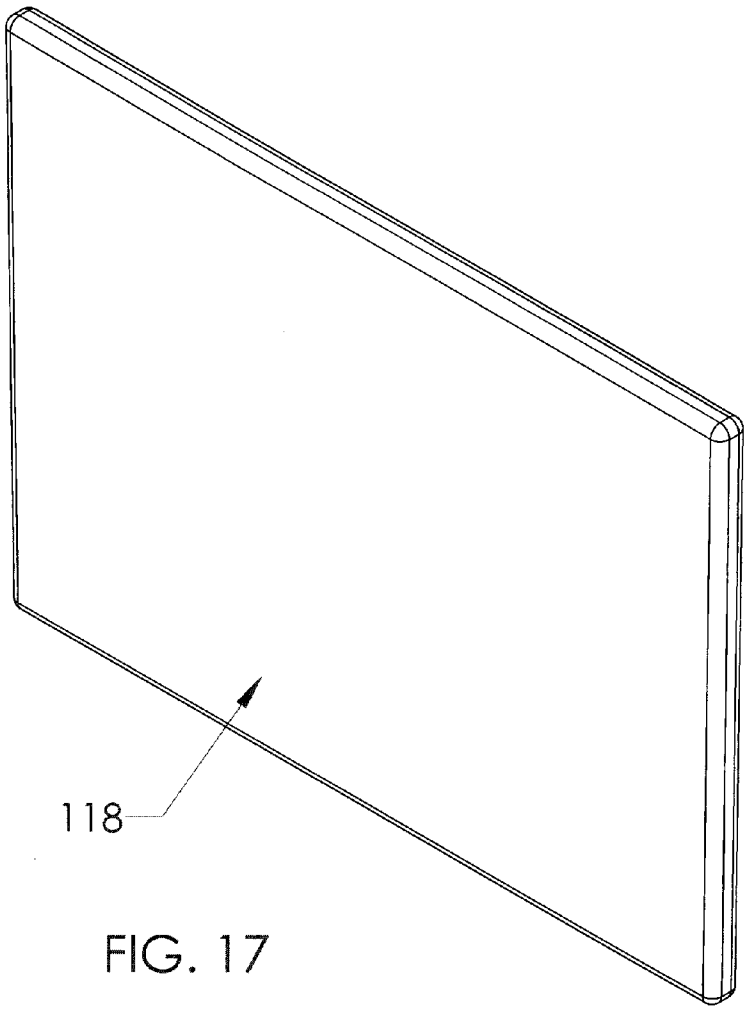
FIG. 17 is a perspective view of a cutting board/divider of the present invention.

The interior of the coolers can be divided into compartments by the use of one or more dividers 118, FIG. 17. The dividers 118 are preferably formed from high density polyethylene. However, other materials can also be employed to make the dividers 118. The interior of the coolers can be provided with slots 120. There is a pair of slots 120 for each divider 118 to be inserted into. The slots are formed on the interior surface of the coolers, as illustrated in FIGS. 8 and 9. The slots are formed on the interiors of the front and back walls of the cooler directly across from each other (FIG. 8). This enables a divider 118 to be easily placed into a pair of slots 120 and divide the interior of the cooler into individual compartments. While an embodiment of the invention (FIGS. 8 and 9) illustrates the cooler being divided into 4 compartments, the cooler can be provided with one or any number of compartments. The divider 118 can also function as a cutting board. Because it is made from a high density plastic, it is resistant to cuts and abrasions. Further, since it is made from a plastic material it can be readily washed or cleansed after it has been used for cutting foods or other substances.

Figure 20:
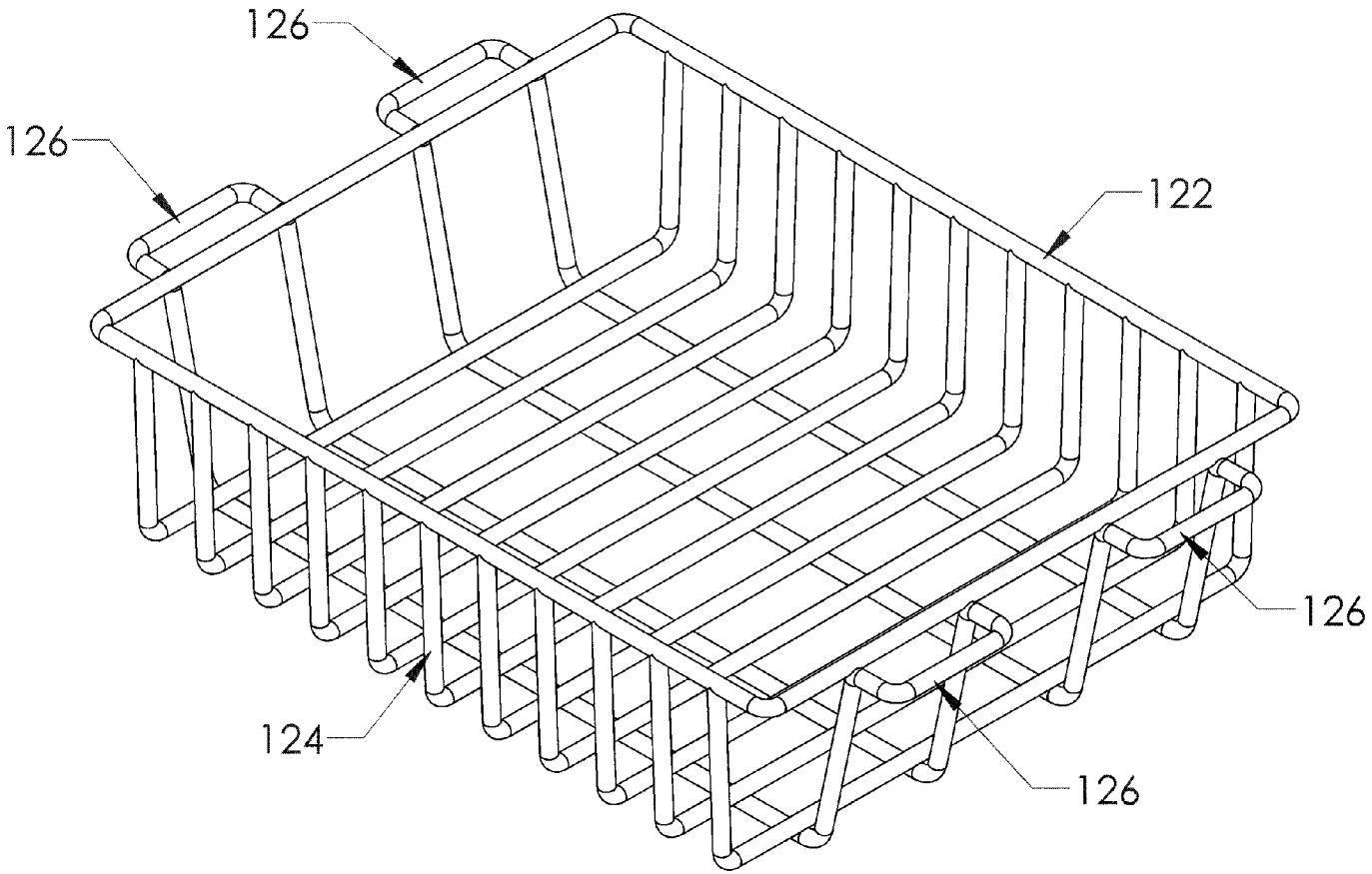
FIG. 20 is a perspective view of a basket or container designed to be placed into the present invention.
Figure 22:
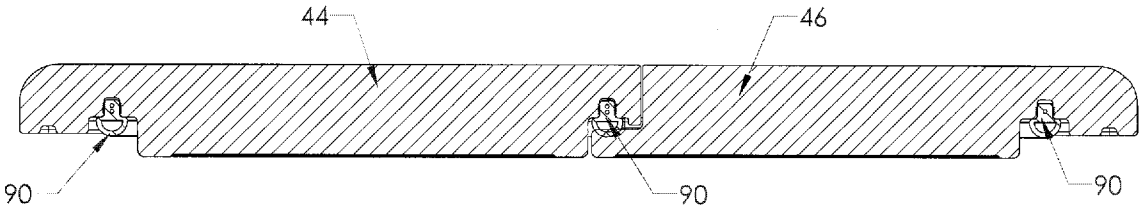
FIG. 22 is a cross-sectional view along line C-C in FIG. 21.
Figure 21:
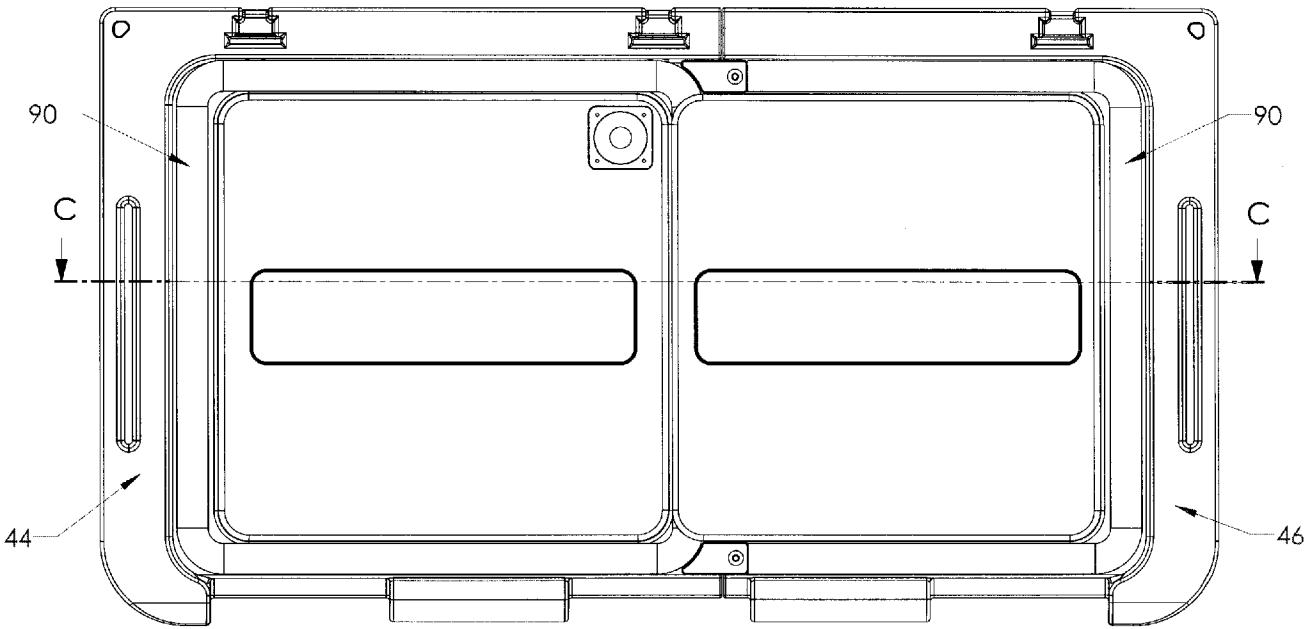
FIG. 21 is a view of the underside of the top of the cooler in FIG. 2.

One of more baskets 122 or containers can be used to hold and retain objects within the cooler. A single basket 122 is illustrated in FIG. 20. The basket is made from a plurality of wires 124 which are bent and secured together. The wires 124 are made from a material which is resistant to moisture and/or coated with a material which is resistant to moisture. The baskets 122 are provided with support extensions 126 at the ends thereof. The support extensions 126 are placed onto ledges 128 or 130 which extend along the front and back walls of the coolers (FIG. 5A). The ledges 130 are at a lower elevation within the interior of the coolers than ledges 128. The extensions 126 of the baskets 122 which are placed on the lower ledges 130 are shorter that the extensions 126 of the baskets places on the upper ledges 130. This enables the baskets to bypass the upper ledge 128 and be secured to the lower ledge 130. The baskets 122 enable items to be stored and organized within the coolers. In addition, the baskets 122 enable one or more groups of items to be easily removed from the cooler so that other items in the cooler can be readily accessed. The basket with items removed then can easily replaced back into the cooler.

Figure 24:
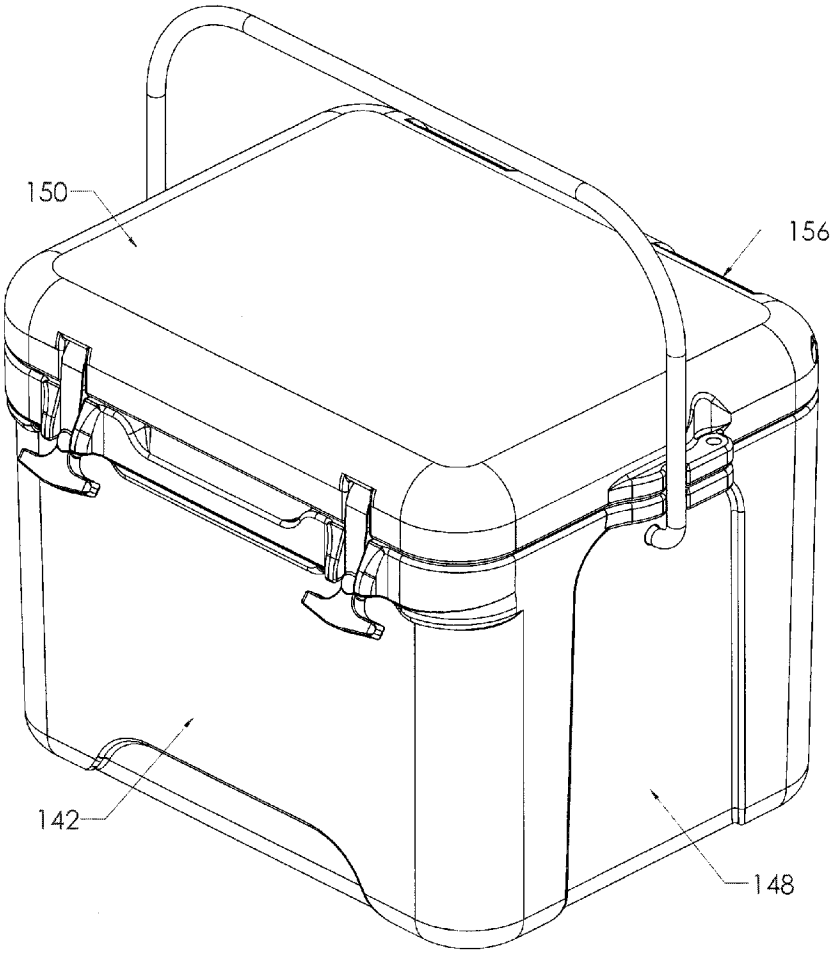
FIG. 24 is a perspective view of another embodiment of the present invention.
Figure 25:
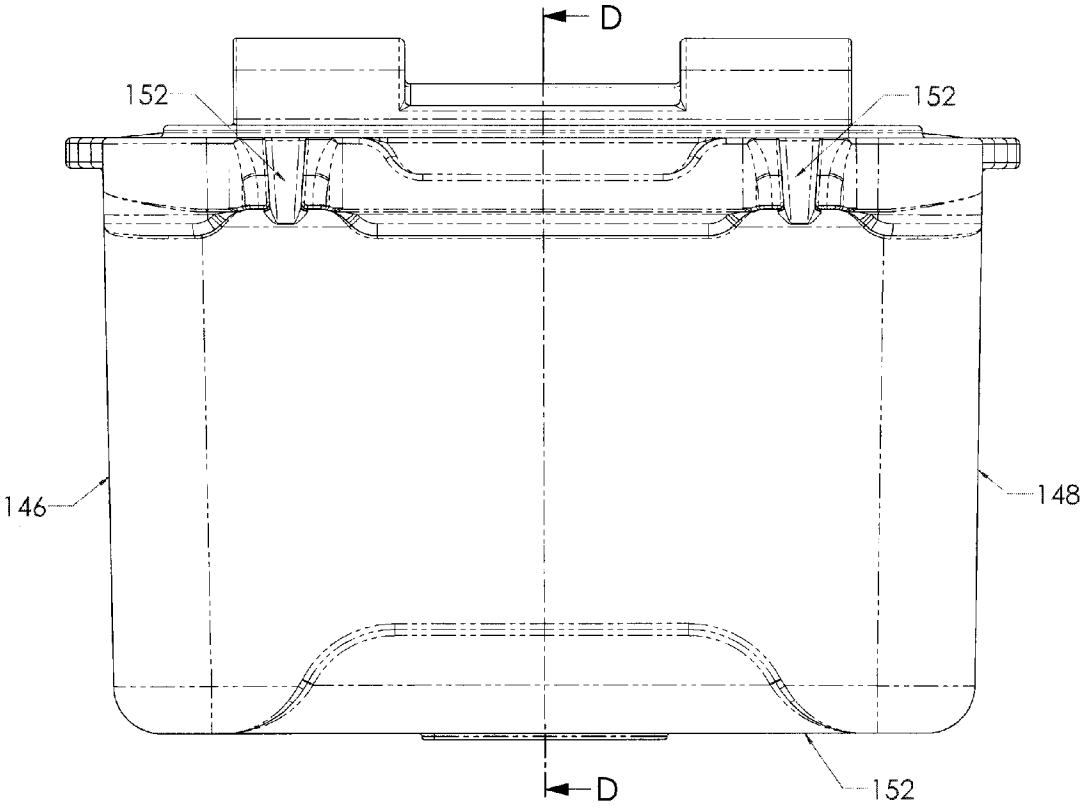
FIG. 25 is a front view of the embodiment of FIG. 23.

Another embodiment of the invention is illustrated in FIGS. 24-35. This embodiment is a smaller version of the previous embodiments. FIG. 24 illustrates this embodiment 140 with the top removed. This embodiment is preferable used to hold small items, as a lunch or a few beverages for example. This embodiment includes a front wall 142, a back wall 144, a left end wall 146, a right end wall 148, a top 150, and a bottom 152. The left end wall, the right end wall, the front wall, the back wall, and the bottom are preferably integrally formed together as a single piece. The top 150 is hingedly secured to the back wall. Latches 152 releasably secure the top to the remainder of the cooler.

Figure 26:
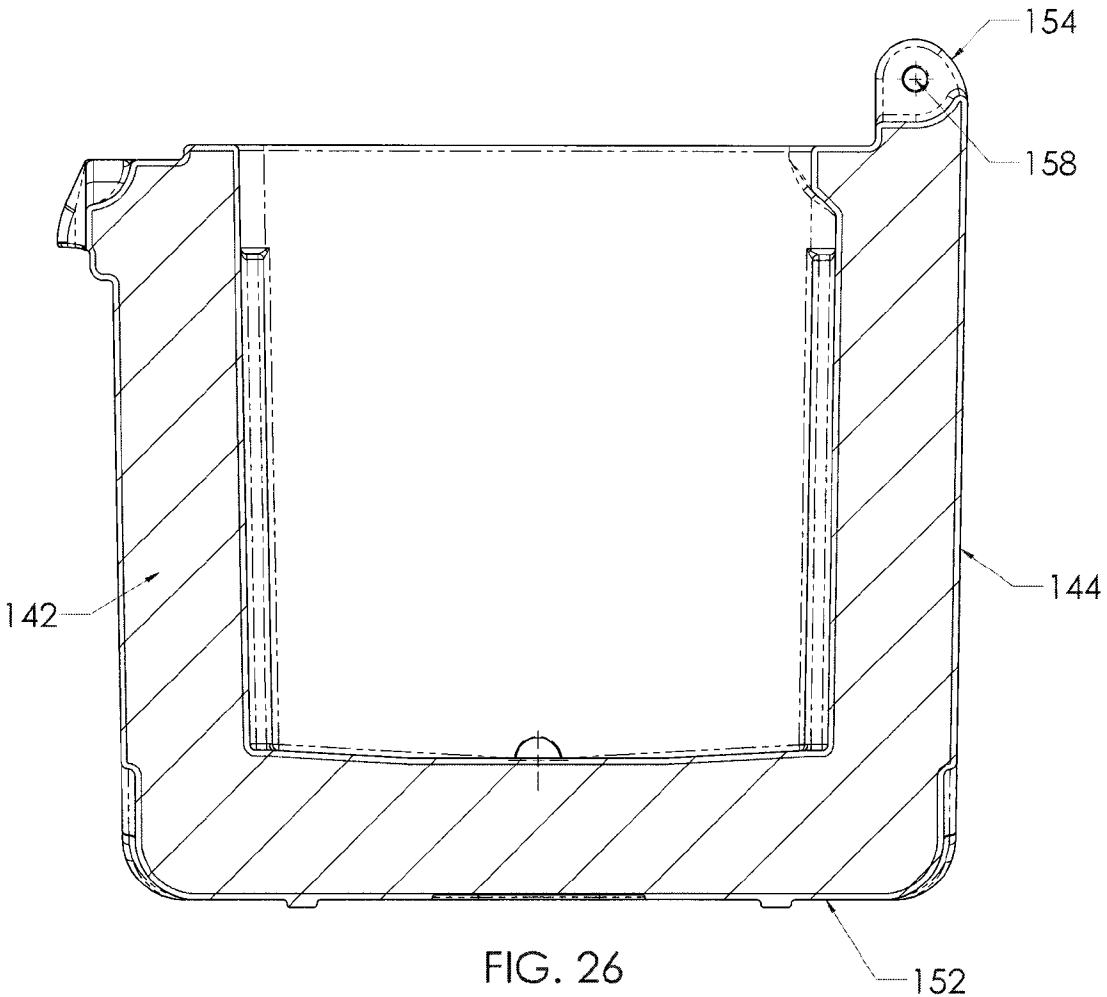
FIG. 26 is a cross-sectional view of FIG. 25 taken along line D-D.
Figure 27:
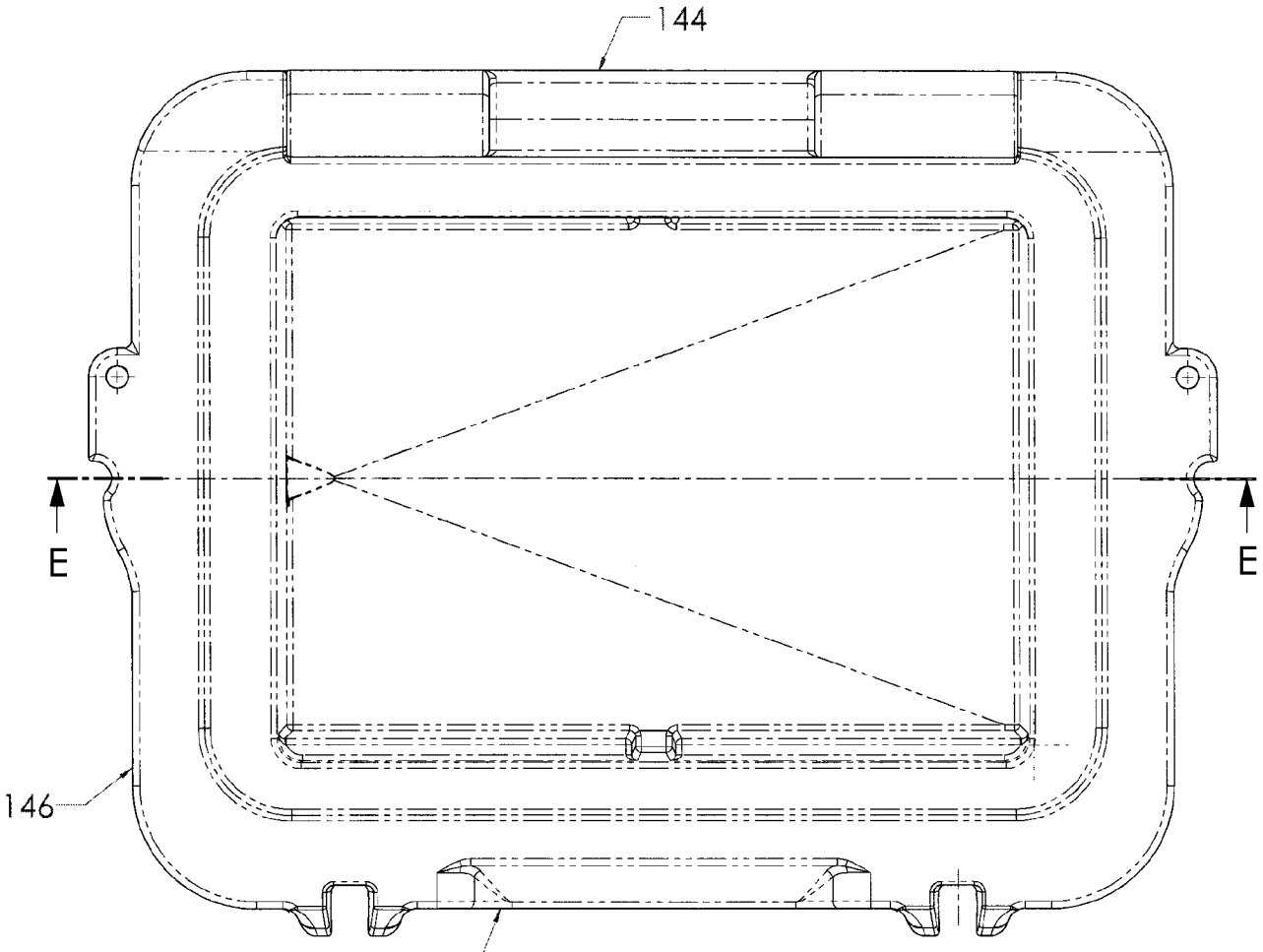
FIG. 27 is a top view of the embodiment of FIG. 24.
Figure 28:
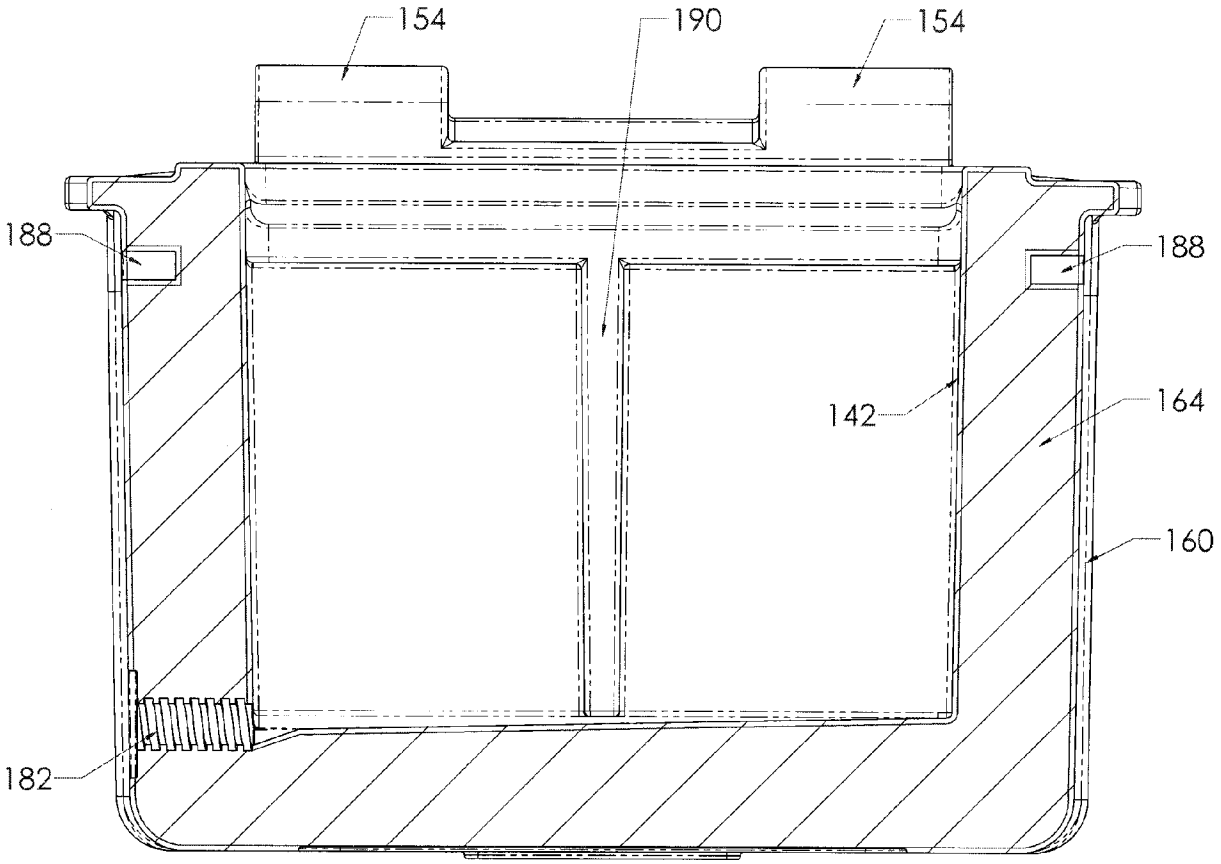
FIG. 28 is a cross-sectional view of FIG. 25 taken along line E-E.
Figure 29:
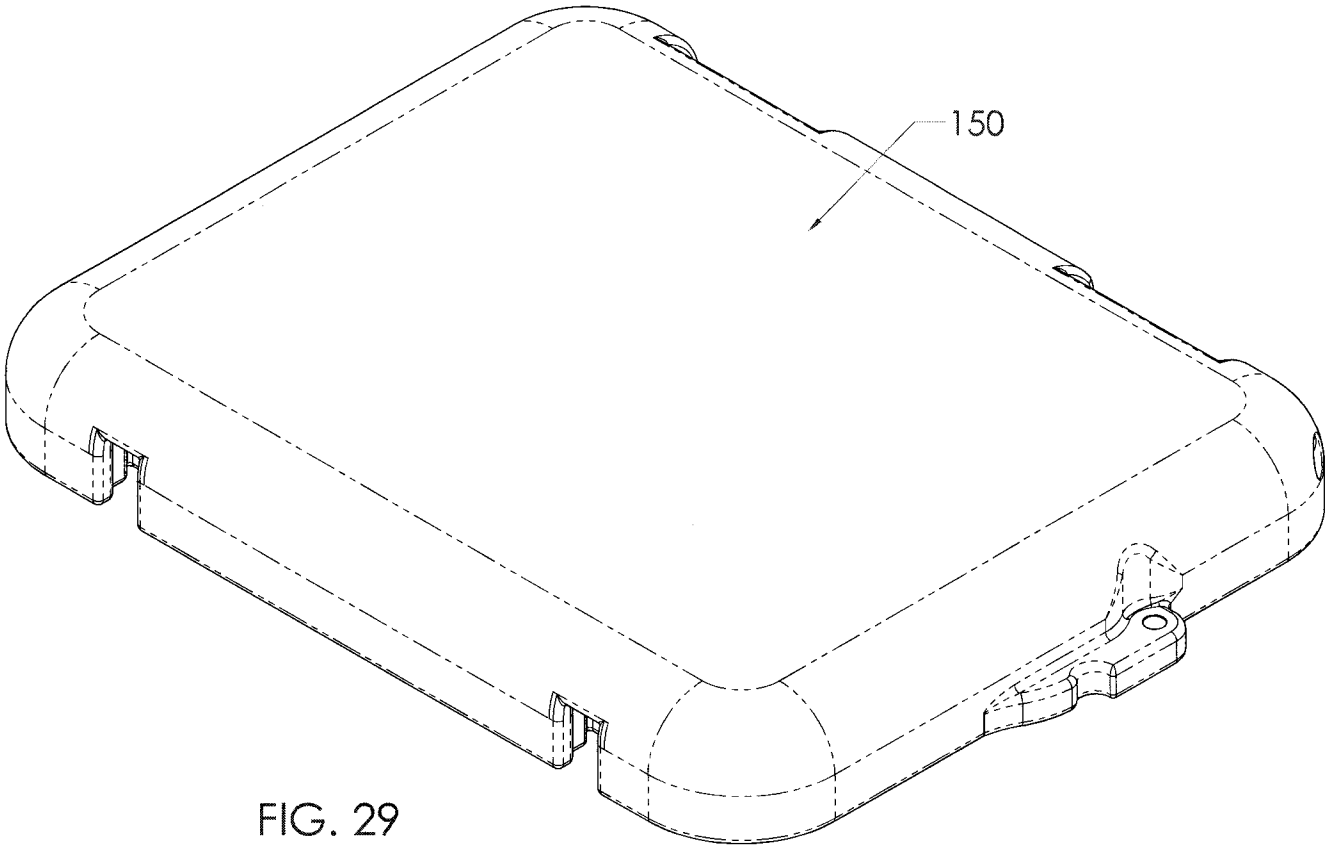
FIG. 29 is a perspective view of the top of the embodiment of FIG. 24.
Figure 30:
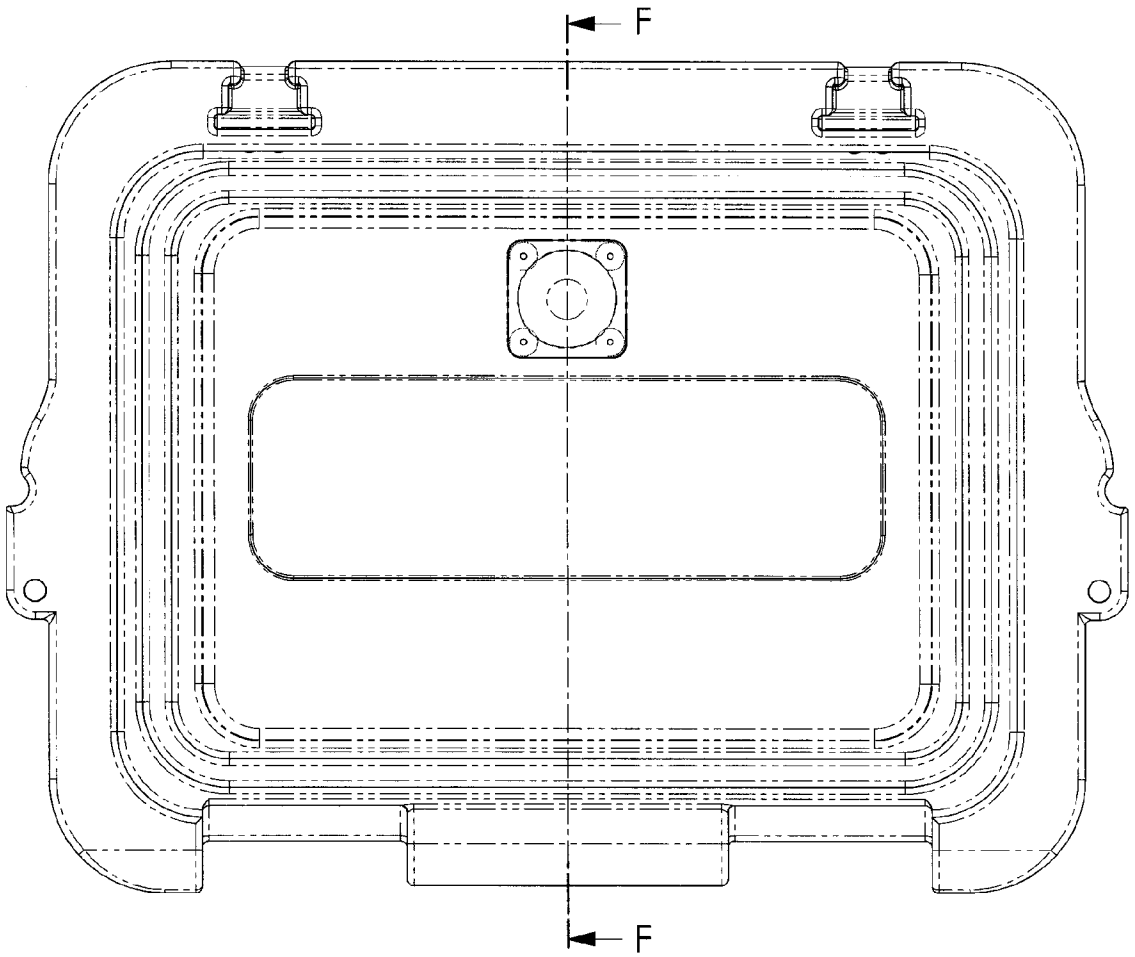
FIG. 30 is an underside view of the top illustrated in FIG. 29.

FIG. 29 illustrates the top 150 of the embodiment 140 of FIG. 24. A hinge includes elements 154 molded to the back 14 of the cooler as illustrated in FIGS. 26 and 28, element 156 molded to the top 150 of the cooler as illustrated in FIG. 24, and pin 158 (FIG. 24). The hinge elements 154 and 156 in this embodiment enable the top 150 to be raised and in vertical alignment with the back wall 144 of the cooler.

The front wall 142, back wall 144, left end wall 146, right end wall 148, and bottom 152 of this embodiment are molded together as a single piece. These elements include an outer layer or thickness 160 of a high density plastic, such as polyethylene, and an inner layer or thickness 162 of a high density plastic, such as polyethylene, see FIG. 28. In a preferred embodiment the layers 160 and 162 are 6 mm thick. However, other thicknesses can also be employed. Positioned between layers 160 and 162 is a layer or thickness 164 of foam, such as polyurethane foam. This foam is relatively thick to provide substantial insulation for the cooler. In a preferred embodiment the foam is 3 inches thick. However, other thicknesses of foam insulation can also be employed. The high density plastic increases the rigidity and strength of the cooler and enables it to be manufactured in larger sizes. These larger sizes enable a greater amount of food and comestibles to be safely retained within the cooler. The larger size coolers also contain a greater amount of ice. The high density plastic enables the coolers to carry this additional ice without damage to the cooler.

Figure 33:
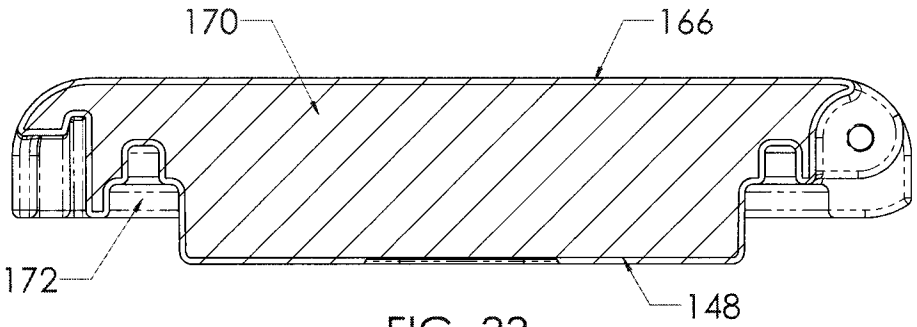
FIG. 33 is a cross-sectional view taken along line G-G of FIG. 32.
Figure 34:
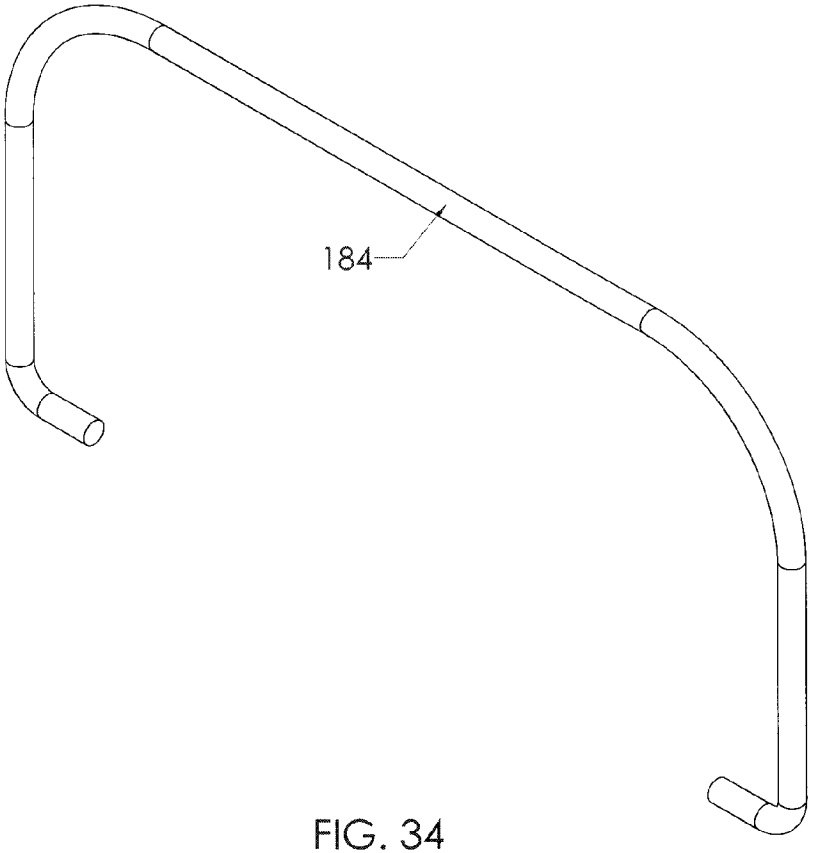
FIG. 34 is a perspective view of the handle of the embodiment of FIG. 24.

The top 150 of the cooler has a construction similar to the front, back, end walls and bottom. As illustrated in FIG. 33, the top 1500 includes an outer layer or thickness 166 of a high density plastic, such as polyethylene, and an inner layer or thickness 168 of a high density plastic, such as polyethylene. In a preferred embodiment the layers 166 and 168 are 6 mm thick. However, other thicknesses can also be employed. Positioned between layers 166 and 168 is a layer or thickness 170 of foam, such as polyurethane foam. This foam is relatively thick to provide substantial insulation for the cooler. In a preferred embodiment the foam is 3 inches thick. However, other thicknesses of foam insulation can also be employed. The high density plastic increases the structural rigidity of the top of the cooler and enables it to withstand increased loads placed thereon. The foam 170 is relatively thick to provide substantial insulation for the cooler. The hinges 154 and 156 are formed completely from a high density plastic. There is no foam used in the formation of the hinges. This construction of the hinges increases the thermal nonconductivity of the cooler, thus enabling the cooler to keep and maintain the contents therein at or below a desired temperature.

Latches 152 are employed to keep the cooler top closed. These latches also help to maintain the top in a sealed condition with respect to the front, back and end walls of the cooler. Latches 152 are similar to latches 24 and 48 of the aforementioned embodiments. The top portion of each latch includes an aperture into which a pin can be inserted. A latch securing member, similar to member 78 is secured to a front portion of the top 150. The latch member includes extensions or ears which extend outwardly from the latch member. The top of each of the latches 152 is positioned between these extensions. A pin is inserted in apertures of the latch and latch member. This construction enables the latches 152 to pivot between a down, closed position and an up, open position.

Figure 31:
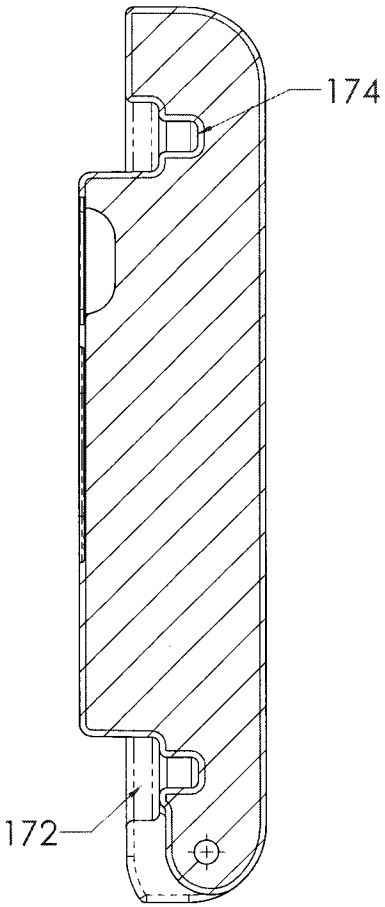
FIG. 31 is a cross-sectional view taken along line F-F in FIG. 30.
Figure 32:
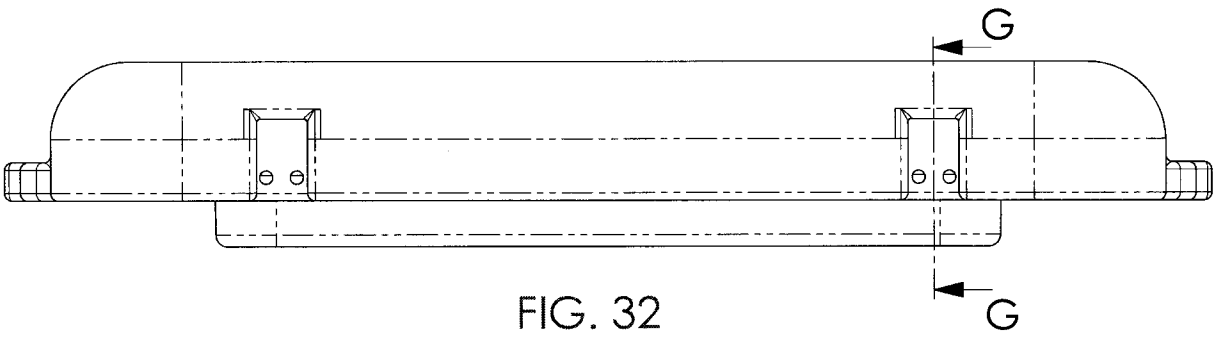
FIG. 32 is a front view of the top illustrated in FIG. 29.
Figure 35:
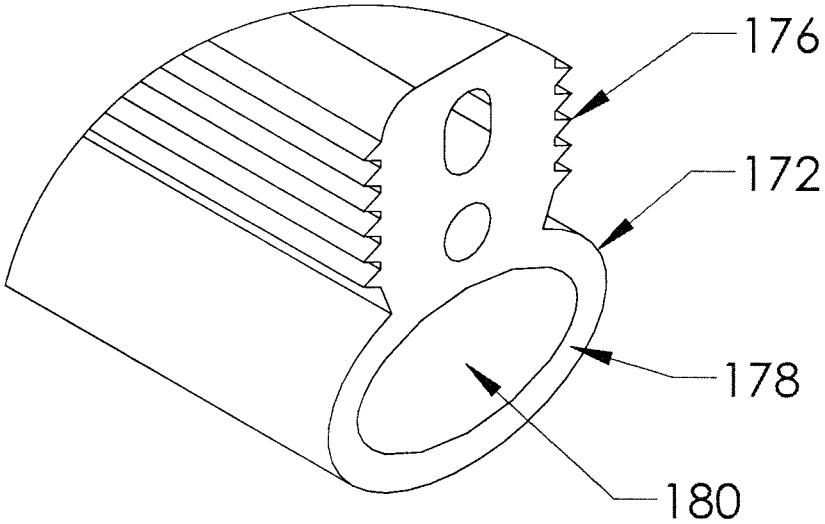
FIG. 35 is a cross-sectional view of the seal in the top illustrated in FIG. 29.

A seal 172 (FIG. 35) is located underneath the top 150 of the cooler. The seal 172 extends completely around the periphery of the top. As illustrated in FIGS. 31 and 33, the seal 172 is located inwardly from the outer circumferential edge of the tops. The seal 172 is set into a groove 174 which extends around the periphery of the tops of the cooler. The seal is maintained in the groove by a friction fit between the seal 172 and the groove 174. A portion 176 of the seal 172 is inserted into the groove 174 to hold the seal in the groove (FIG. 35). Other means, such as fasteners, adhesive, etc., can also be utilized to maintain the seal 172 in groove 174. Seal 172 includes a flexible portion 178 which deforms and maintains a sealed condition when the top is closed and the latches are engaged. The interior 180 of the seal may contain air or other gases. These gases can help to maintain the contents of the cooler at or below a desired temperature.

The seal 172 abuts against a ridge which extends around an upper edge of the front, back and end walls of the cooler. The ridge helps to assure an air tight, thermal barrier between the exterior of the cooler and the interior of the cooler. The flexibility of the seal 172 permits the seal to compensate for any imperfections in the ridge, should any imperfections occur. The seal 172 is preferably formed as a single piece.

However, the seal 172 can also be formed as multiple pieces which are abutted together in the groove 174. While the material used for the seal 172 is preferably an elastomeric material, any other similar, flexible material, such as rubber, plastics, felt, etc., can also be used to make the seal.

The bottom of this embodiment of the cooler can be provided with feet and a skid bar similar to the feet 102 and skid bars 103 of the previous embodiments. This embodiment can also be provided with a bottle opener similar to 106 in FIG. 18. An aperture 182 (FIG. 28) is located adjacent the bottom and at one end of the interior of the cooler. A plug or stopper, not shown, is inserted into aperture. The aperture is used to drain fluids, such as melted ice, from the interior of the cooler. While the preferred embodiment of the plug is threaded, it can also have other shapes and be held in the aperture 182 by a friction fit. Additionally, the plug can employ a mechanism which expands the exterior of the plug after is has been inserted into the aperture.

A single handle 184 (FIG. 34) is utilized to lift and carry this embodiment of the cooler. The ends 186 of handle 184 are pivotally secured in apertures 188 (FIG. 28) at the upper portion of the end walls. This enables the handle to be pivoted to an upright position for carrying and to a lower position enabling the top of the cooler to be opened. Handle 34 is preferably made from wire, but any other materials can also be utilized.

The interior of the cooler can be divided into compartments by the use of one or more dividers similar to dividers 118 (FIG. 17). The dividers 118 are preferably formed from high density polyethylene. However, other materials can also be employed to make the dividers 118. The interior of the cooler can be provided with slots 190. There is a pair of slots 190 for each divider 118 to be inserted into. The slots are formed on the interior surface of the coolers, as illustrated in FIG. 28. The slots are formed on the interiors of the front and back walls of the cooler directly across from each other. This enables a divider 118 to be easily placed into a pair of slots 190 and divide the interior of the cooler into individual compartments. The divider 118 can also function as a cutting board. Because it is made from a high density plastic, it is resistant to cuts and abrasions. Further, since it is made from a plastic material it can be readily washed or cleansed after it has been used for cutting foods or other substances.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A portable thermally nonconductive container comprising:

a front wall; a back wall; a bottom; and opposite end walls forming a unitary container defining an interior and an exterior;

at least one top hingedly secured to said unitary container for enclosing the interior;

each of said front wall, said back wall, said bottom, said end walls and said at least one top including an inner layer of a high density thermally nonconductive material, an outer layer of a high density thermally nonconductive material, and a layer of a thermally nonconductive foam material between said inner and said outer layers, the thickness of said inner and said outer layer being substantially less that the thickness of said foam material;

an upper ledge formed from a recess along an interior longitudinal length of said front wall and back wall for receipt of a removable upper basket having extensions constructed and arranged to reside in the upper ledge recesses allowing slidable positioning of said upper basket along an internal length formed within the unitary container;

a lower ledge formed from a recess along an interior longitudinal length of said front and back wall for receipt of a removable lower basket having extensions constructed and arranged to reside in the lower ledge recesses allowing slidable positioning of said lower basket along the internal length of the unitary container, said upper basket and upper ridge is larger than said lower basket and lower ridge allowing placement of said upper basket over said lower basket;

a divider slot formed from a vertical recess along an interior length of said front and back wall for receipt of a removable divider;

a seal constructed from an elastomeric material secured to and extending substantially around said at least one top, said seal being constructed and arranged to cooperate with a top edge of said front wall, said back wall and said end walls to form a thermally nonconductive barrier between the interior of said thermally nonconductive container and the exterior of said thermally nonconductive container; and a plurality of latches releasably secured between said top and said front wall, said latches being constructed and arranged to secure said top in a closed position when simultaneously engaging said top and said front wall, said latches and said seal both providing a thermally nonconductive barrier between the interior and exterior of said thermally nonconductive container.

2. The portable thermally nonconductive container of claim 1 wherein said top includes at least two members, each of said at least two members being openable and closable separately from each other; and latches on said top members and said front wall constructed and arranged to maintain each of said at least two top members in a closed condition.

3. The portable thermally nonconductive container of claim 1 including a plurality of supports secured to said bottom of said thermally nonconductive container, said supports being constructed and arranged to raise said bottom of said thermally nonconductive container above a support surface and protect said bottom of said thermally nonconductive container from damage by the support surface.

4. The portable thermally nonconductive container of claim 1 including a plurality of hinges having a single hinge pin commonly connecting said hinges, said hinges formed on said top and said back wall of said thermally nonconductive container, said hinges enable said top to be vertically aligned with said back wall when said top is opened.

5. The portable thermally nonconductive container of claim 4 wherein said hinges are formed solely from a high density plastic material.

6. The portable thermally nonconductive container of claim 2 wherein said top includes at least two members, each of said at least two members being openable and closable separately from each other; and latches on said top members and said front wall constructed and arranged to maintain each of said at least two top members in a closed condition.

7. The portable thermally nonconductive container of claim 6 including a plurality of hinges formed on said top and said back wall of said thermally nonconductive container, said hinges enable said top to be vertically aligned with said back wall when said top is opened.

8. The portable thermally nonconductive container of claim 7 wherein said hinges are formed solely from a high density plastic material.

9. The portable nonconductive container of claim 1 wherein said removable divider is formed of a high density plastic.

* * * * *